US008335460B2

(12) United States Patent
Ichizawa et al.

(10) Patent No.: US 8,335,460 B2
(45) Date of Patent: Dec. 18, 2012

(54) RESIN FILM MANUFACTURING METHOD, TRANSFER BELT, TRANSFER UNIT, AND IMAGE FORMING APPARATUS

(75) Inventors: Nobuyuki Ichizawa, Kanagawa (JP); Masato Ono, Kanagawa (JP); Tomoko Suzuki, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 520 days.

(21) Appl. No.: 12/553,533

(22) Filed: Sep. 3, 2009

(65) Prior Publication Data

US 2010/0239764 A1 Sep. 23, 2010

(30) Foreign Application Priority Data

Mar. 19, 2009 (JP) ..... 2009-068769
Mar. 19, 2009 (JP) ..... 2009-068771

(51) Int. Cl.
*G03G 15/01* (2006.01)

(52) U.S. Cl. ..... 399/302; 399/121; 427/336; 428/35.7

(58) Field of Classification Search ..... 399/121, 399/302; 427/336; 428/35.7
See application file for complete search history.

(56) References Cited

U.S. PATENT DOCUMENTS

| | | | | |
|---|---|---|---|---|
| 6,646,040 | B1 | 11/2003 | Hara et al. | |
| 2003/0084726 | A1 * | 5/2003 | Yamazaki et al. | 73/587 |
| 2004/0080048 | A1 | 4/2004 | Haruta et al. | |
| 2005/0118361 | A1 * | 6/2005 | Natori et al. | 428/32.69 |
| 2006/0240248 | A1 * | 10/2006 | Kanai | 428/336 |

FOREIGN PATENT DOCUMENTS

| | | |
|---|---|---|
| JP | A-62-042813 | 2/1987 |
| JP | A-62-051106 | 3/1987 |
| JP | A-62-206567 | 9/1987 |
| JP | A-07-126412 | 5/1995 |
| JP | A-7-161236 | 6/1995 |
| JP | A-2001-84842 | 3/2001 |
| JP | A-2001-324880 | 11/2001 |
| JP | 2002-105315 | 4/2002 |
| JP | A-2002-139923 | 5/2002 |

(Continued)

OTHER PUBLICATIONS

Office Action issued in Japanese Application No. 2009-068771 dated Jan. 5, 2011 (with translation).

(Continued)

*Primary Examiner* — Walter L Lindsay, Jr.
*Assistant Examiner* — Ruth Labombard
(74) *Attorney, Agent, or Firm* — Oliff & Berridge, PLC

(57) ABSTRACT

A tubular body 101 includes a layer containing a resin and conductive particles 112, the layer having a first region 111C that is free of conductive particles and lies at the outermost surface, and a second region 111B that has higher conductivity than other regions and lies closer to the innermost surface than the first region. A coating film of a coating liquid containing the conductive particles and resin material is dried, and then an eluting solvent for eluting the resin material from the film is applied thereto. As a result of this, the conductive particles are localized in the coating film at the side coated with the eluting solvent. Thereafter, upon drying the eluting solvent, the resin material dissolved in the eluting solvent deposits on the region where the conductive particles are localized, whereby a particle-free resin region free of the conductive particles is formed.

10 Claims, 10 Drawing Sheets

FOREIGN PATENT DOCUMENTS

| | | |
|---|---|---|
| JP | A-2003-211468 | 7/2003 |
| JP | A-2004-346143 | 12/2004 |
| JP | A-2005-266338 | 9/2005 |
| JP | A-2006-173790 | 6/2006 |
| JP | A-2007-298692 | 11/2007 |

OTHER PUBLICATIONS

Office Action issued in Japanese Application No. 2009-068769 dated Feb. 8, 2011 (with translation).

* cited by examiner

RESIN FILM MANUFACTURING METHOD, TRANSFER BELT, TRANSFER UNIT, AND IMAGE FORMING APPARATUS

CROSS-REFERENCE TO RELATED APPLICATIONS

This application is based on and claims priority under 35USC 119 from Japanese Patent Application No. 2009-068769 filed on Mar. 19, 2009 and Japanese Patent Application No. 2009-068771 filed on Mar. 19, 2009.

BACKGROUND

1. Technical Field

The present invention relates to a method for manufacturing a resin film, and also to a transfer belt, a transfer unit, and an image forming apparatus.

2. Related Art

Some resin films containing functional particles in resin are used as functional films. Various methods for producing these films have been studied and developed.

An image forming apparatus using an electrographic system is one example of an apparatus in which a resin film in which functional particles are included in a resin is used.

In the image forming apparatus using an electrographic system, a charge is formed on an image holder, which is a photoconductive photoreceptor formed of an inorganic or organic material, an electrostatic latent image is formed with laser light or the like generated by modulation of image signals, and then the electrostatic latent image is developed with a charged toner into a visible toner image. Subsequently, the toner image is electrostatically transferred to a material such as recording paper directly or via an intermediate transfer medium, thereby giving a reproduced image.

SUMMARY

According to an aspect of the invention, a tubular body is provided, which includes a layer containing a resin and conductive particles, the layer having a first region that is free of the conductive particles and is provided at an outermost surface, and a second region that has higher conductivity than other regions and is provided closer to an innermost surface than the first region.

BRIEF DESCRIPTION OF THE DRAWINGS

Exemplary embodiments of the present invention will be described in detail based on the following figures, wherein.

DETAILED DESCRIPTION

The exemplary embodiments of the present invention are further described below with reference to drawings.

-First Exemplary Embodiment-

Figure 1:
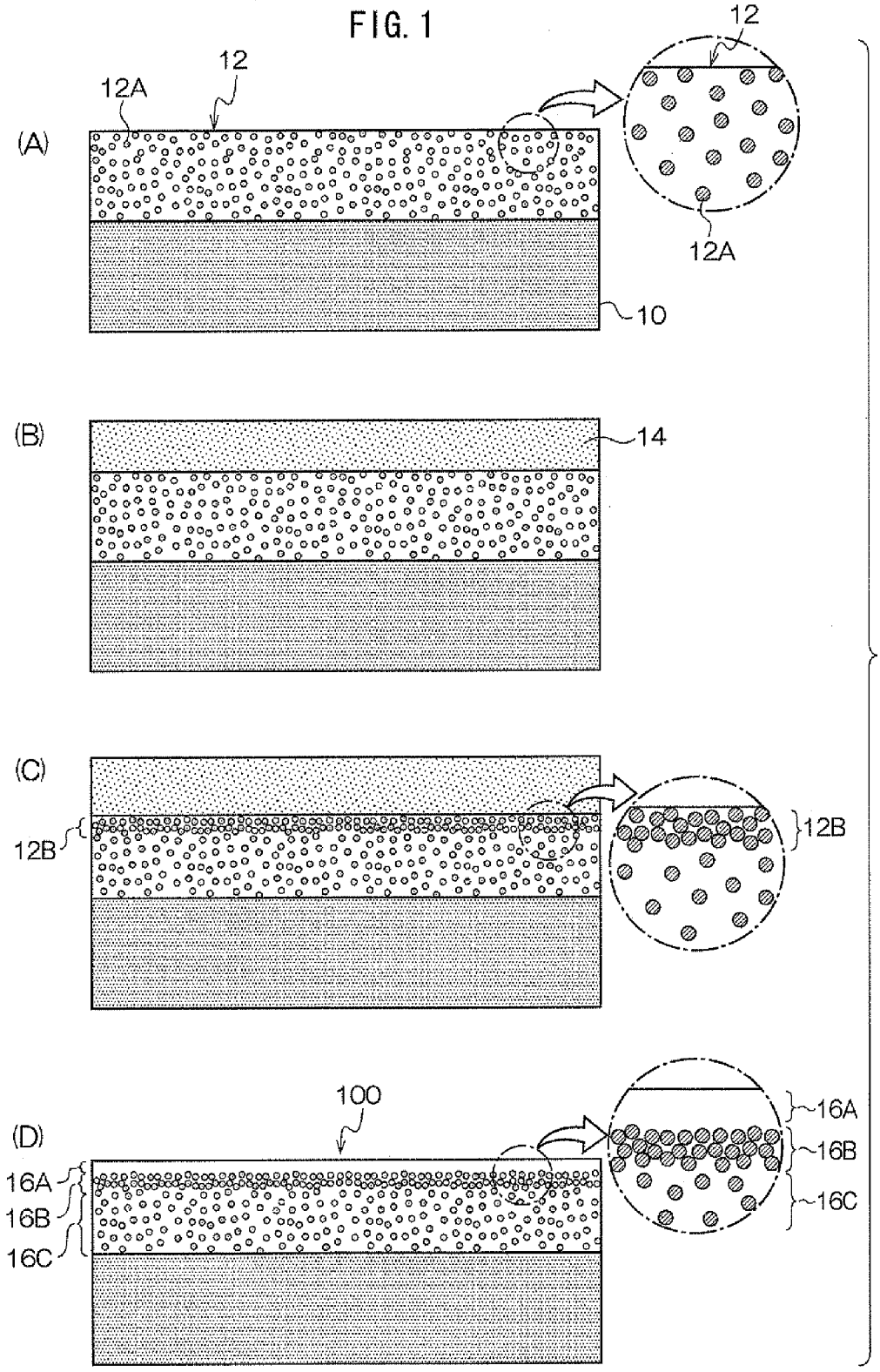
FIG. 1 is a process chart showing a method for manufacturing a resin film according to a first exemplary embodiment.

FIG. 1 is a process chart showing a method for manufacturing a resin film according to a first exemplary embodiment.

In the method for manufacturing a resin film according to the present exemplary embodiment, firstly, a coating liquid containing functional particles 12A, a resin material, and a solvent is prepared. Then, as shown in FIG. 1(A), the coating liquid is applied to a substrate 10, thereby forming a coating film 12 of the coating liquid.

The form of the substrate 10 is selected according to the resin film to be produced, and may be, for example, a tube-shaped or flat-shaped die.

The method for applying the coating liquid to the substrate 10 is not particularly limited. For example, when the substrate 10 is a cylindrical die, the outer peripheral surface is immersed in the coating liquid, the coating liquid is applied to the inner peripheral surface, the coating liquid is applied to the inner peripheral surface, followed by rotation of the die, or the coating liquid is charged into an injection die, thereby forming an endless coating film 12. When the substrate is a flat-shaped die, for example, the coating film 12 may be formed using a wire bar or an inkjet method.

Thereafter, the coating film 12 applied to the substrate 10 is dried. The coating film 12 is dried such that the proportion of residual solvent is 25% or less, preferably 20% or less, and more preferably 15% or less. If the proportion of residual solvent in the coating film 12 is too high, the below-described localization (increase of density) of the functional particles 12A hardly occurs. The lower the proportion of residual solvent, the more readily the below-described localization (increase of density) of the functional particles 12A occurs. The control of the proportion of residual solvent in the coating film 12, that is, the dry state of the coating film 12 allows the control of the degree of localization (congestion) of the functional particles 12A described below, and the location of the region containing the functional particles 12A in a localized state (particle-localized resin layer 16B) in the thickness direction of the resin film 100 to be produced.

The proportion of residual solvent refers to the proportion of the solvent weight remaining in the dried coating film with reference to the solvent weight contained in the coating liquid to be applied. The proportion of residual solvent is determined as described below.

For example, when the weight of the solid resin material (dry weight of resin material) and the weight of the functional particles are known, the total weight of the undried coating film is accurately measured, whereby the solvent weight contained in the total weight of the coating film is calculated. Then, the total weight of the dried coating film is accurately measured, the decrement is calculated as the weight of dissipated solvent by the formula: (weight of undried coating film−weight of dried coating film)/(weight of undried coating film−weight of solid resin−weight of functional particles), thereby determining the proportion of residual solvent.

The proportion of residual solvent may be determined using a thermal extraction gas chromatograph-mass spectrograph. An example of the measurement is described below. For example, a portion of the dried coating film is cut out with a weight of about 2 mg or more and 3 mg or less to make a sample, the sample is weighed, and heated to 400° C. in a thermal extraction apparatus (trade name: PY2020D, manufactured by Frontier Laboratories Ltd.). The volatile components are injected into a gas chromatograph-mass spectrograph by way of an interface at 320° C. (trade name: GCMS-QP2010, manufactured by Shimadzu Co., Ltd.), and the quantity is determined. More specifically, helium gas as a carrier gas is injected in an amount of 1/51 (split ratio, 50:1) of the amount of evaporation from the sample into a column (trade name: capillary column UA-5, manufactured by Frontier Laboratories Ltd.) having an inside diameter of 0.25 μm and a length of 30 m at a linear velocity of 153.8 cm/second (carrier gas flow rate of 1.50 ml/minute and pressure of 50 kPa at column temperature of 50° C.). The column is kept at 50° C. for 3 minutes, and then the column temperature is increased to 400° C. at a ratio of 8° C./minute, and the temperature is kept for 10 minutes, thereby desorbing the volatile components. Further, the volatile components are injected into the mass spectrograph at an interface temperature of 320° C., and the peak area corresponding to the solvent is determined. The quantitative determination is carried out on the basis of an analytical curve prepared using the same solvent in known amounts. The determined solvent weight is divided by the weight of the dried sample, thereby calculating the proportion of residual solvent. The above-described procedure of measurement is one example, and the conditions may be changed according to the temperature at which the resin is decomposed or changed, or the boiling point of the solvent.

Then, as shown in FIG. 1(B), an eluting solvent 14 for eluting the resin material is applied to the surface of the dried coating film 12. In the region coated with the eluting solvent 14, the eluting solvent 14 permeates through the dried coating film 12 to swell the region below the coated surface of the coating film 12. At this time, the amount of the eluting solvent 14 on the coated surface of the coating film 12 is greater, that is, the solvent concentration is higher than that in the region below the coated surface of the coating film 12, so that the resin material is more readily eluted into the portion of the eluting solvent 14 on the coated surface of the coating film 12.

As shown in FIG. 1(C), since the functional particles 12A will not dissolve in the eluting solvent 14, the density of the functional particles 12A in the region where the resin materials has dissolved increases with the elution of the resin material and becomes greater than that in the other regions. As a result, a region containing the functional particles 12A in a localized state is formed. In FIG. 1(C), 12B represents the region where the functional particles 12A are localized.

The coating weight of the eluting solvent 14 is, for example, 0.001 g/cm$^2$ or more and 1 g/cm$^2$ or less, preferably 0.01 g/cm$^2$ or more and 1 g/cm$^2$ or less, and more preferably 0.01 g/cm$^2$ or more and 0.5 g/cm$^2$ or less.

The eluting solvent 14 is applied by the method used for applying the coating liquid containing the functional particles 12A and the resin material.

Thereafter, as shown in FIG. 1(D), the eluting solvent 14 applied to the surface of the coating film 12 is dried. The eluting solvent 14 is to be dried such that the proportion of residual solvent is, for example, 10% or less. The proportion of residual solvent is selected in accordance with, for example, the type of the resin material to be used, the intended use of the resin film produced, and the strength and maintainability of the resin film produced.

As described above, the eluting solvent 14 contains the resin material dissolved therein. Therefore, the resin material deposits on drying of the eluting solvent 14, and forms a layer on the region where the functional particles 12A are localized. The eluting solvent 14 is free of or contains the functional particles 12A in a lower amount than the other regions, so that a particle-free resin layer 16A containing no functional particles 12A is formed on the region containing the functional particles 12A in a localized state. Then, a particle-localized resin layer 16B containing the functional particles 12A in a localized state is formed below the particle-free resin layer 16A, and a particle-containing resin layer 16C containing the functional particles 12A at a lower density is formed below the particle-localized resin layer 16B. The particle-free resin layer 16A normally contains no particle, but may contain some functional particles 12A which had migrated into the applied eluting solvent 14 depending on the method.

Through the above-described processes, the resin film 100 composed of three regions having different particle densities (particle-free resin layer 16A, particle-localized resin layer 16B, and particle-containing resin layer 16C) is produced. Thereafter the resin film 100 is removed from the substrate 10, and is subjected to forming and processing according to the intended use.

When a resin precursor such as a polyimide resin is used as the resin material, drying of the eluting solvent 14 is followed by calcination, thereby producing the resin film 100.

The state of localization (congestion) of the functional particles 12A is observed by, for example, atomic force microscope (AFM) analysis. For example, when conductive particles are used as the functional particles, they are observed using D3000 and NANOSCOPE III manufactured by Digital Instruments under following conditions: measurement mode: contact mode, cantilever: Au-coated conductive cantilever, spring constant: 0.2 N/m, and applied voltage: −5 V. The observation sheet is embedded, a silver paste electrode is formed in parallel to the depth direction, and used as the counter electrode of the cantilever. Under the above-described conditions, the state of localization of the particles is observed on the basis of the conductive points in a 10 μm square and height information. On the other hand, when non-conductive particles are used as the functional particles, the presence or absence of the functional particles is confirmed on the basis of height information.

In the method for manufacturing the resin film 100 according to the present exemplary embodiment, the coating film 12 formed from the coating liquid containing the functional particles 12A and the resin material is dried, and then the eluting solvent 14 for eluting the resin material is applied thereto. As a result, as described above, the functional particles 12A are localized in the coating film 12 coated with the eluting solvent 14. Thereafter, the eluting solvent 14 is dried to deposit the resin material dissolved in the eluting solvent 14 on the region where the functional particles 12A are localized, thereby forming the particle-free resin layer 16A free of the functional particles 12A. More specifically, in the region coated with the eluting solvent 14, the particle-localized resin layer 16B containing the functional particles 12A in a localized state is covered with the particle-free resin layer 16A, so that the functional particles 12A are not exposed at the surface of the resin film produced, but embedded in the film. Accordingly, in comparison with other method, the present method more easily produces a resin film containing the functional particles 12A in a localized state.

In the method for manufacturing the resin film 100 according to the present exemplary embodiment, the eluting solvent 14 is applied to the entire surface of the dried coating film 12. Alternatively, the eluting solvent 14 may be applied to a portion of the surface of the coating film 12.

For example, when the eluting solvent 14 is applied to the entire surface of the dried the coating film 12, as described above, the particle-free resin layer 16A formed of the resin film surface serves as a protective layer to prevent the functional particles 12A from being exposed from the resin film. More specifically, for example, when the functional particles 12A are conductive particles, owing to the prevention of exposure of the conductive particles, an antistatic film is produced in which the front surface resistivity is lower than the back surface resistivity.

On the other hand, when the eluting solvent 14 is applied to a portion of the surface of the dried coating film 12, the eluting solvent 14 may be applied in a pattern such as mesh, dots, or lattice on the dried coating film 12.

Figure 2A:
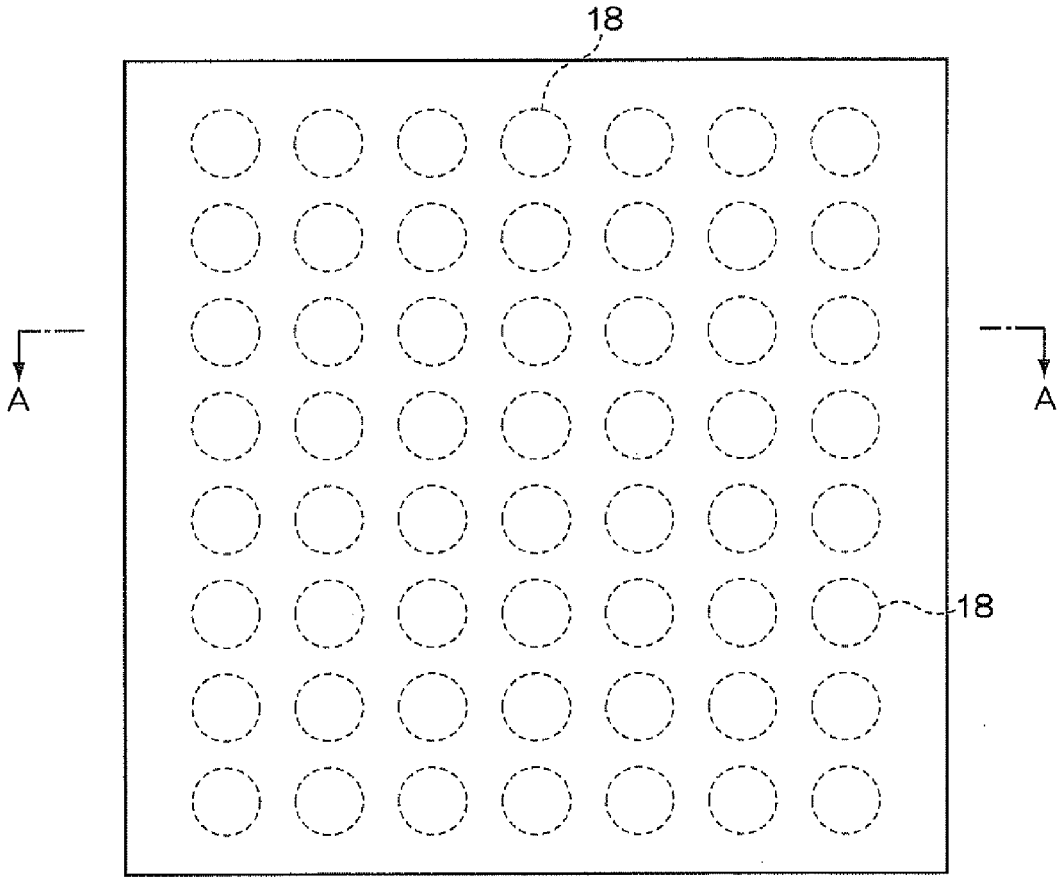
FIG. 2A is a schematic plan view showing a resin film obtainable by a method for manufacturing a resin film according to another exemplary embodiment.
Figure 2B:
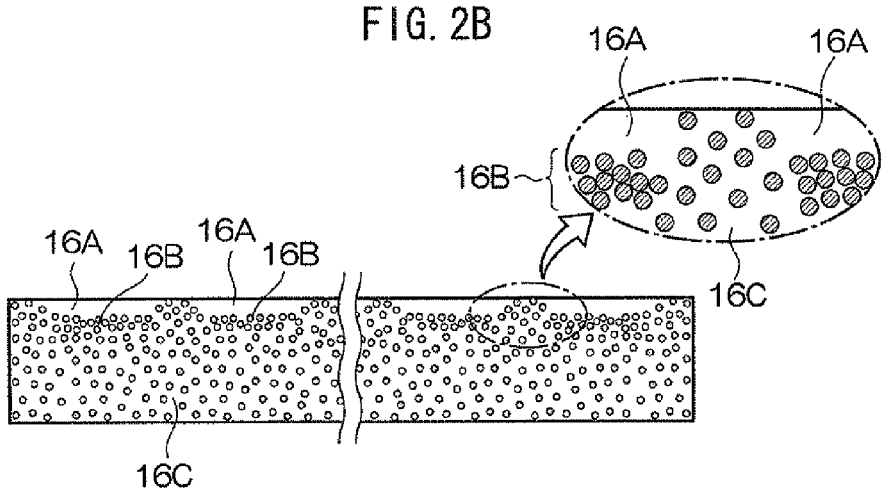
FIG. 2B is a schematic cross sectional view showing an A-A cross section of FIG. 2A.

FIG. 2A is a schematic plan view showing a resin film obtainable by the method for manufacturing a resin film according to another exemplary embodiment, and FIG. 2B is a schematic cross sectional view showing an A-A cross section of FIG. 2A. In the present exemplary embodiment, as shown in FIGS. 2A and 2B, the functional particles 12A are localized along the shape of the region coated with the eluting solvent 14 to form the particle-localized resin layer 16B, and a region in which the particle-localized resin layer 16B is covered by the particle-free resin layer 16A is formed. As a result, a pattern is formed at the region. In the exemplary embodiment shown in FIG. 2A, the eluting solvent 14 is applied in the form of dots. In FIG. 2A, reference numeral 18 indicates the region coated in the form of the dots with the eluting solvent 14.

More specifically, for example, when the functional particles 12A are conductive particles, the particle-localized resin layer 16B is formed in the region coated with the dots of the eluting solvent 14 (that is, the conductive particles congregate densely in the region), so that the resin film produced has low volume resistivity overall, while the particle-free resin layer 16A, which is formed so as to cover the particle-localized resin layer 16B, serves as a protective layer to prevent exposure of the conductive particles, whereby the resin film produced has high surface resistivity overall. As a result, the anisotropic conductive film thus produced has higher surface resistivity and lower volume resistivity than other anisotropic conductive films having a different structure.

Alternatively, for example, when the functional particles 12A are hydrophilic particles, in the region coated with the eluting solvent 14, the particle-localized resin layer 16B containing the localized hydrophilic particles is covered by the particle-free resin layer 16A so as to have no hydrophilicity, while in the region uncoated with the eluting solvent 14, the hydrophilic particles are exposed to exhibit hydrophilicity. As a result, a flexible plate useful as a PS plate (lithographic plate) for offset printing is obtained.

The materials used in the method for manufacturing the resin film 100 according to the present exemplary embodiment are described below. The reference numerals are omitted hereinafter.

Firstly, the coating liquid is described. The coating liquid at least contains functional particles and a resin material.

Examples of the functional particles include, but not limited to, those imparting conductivity (conductive particles), magnetism (magnetic particles), or mechanical strength to the resin film, and those controlling hydrophilicity/hydrophobicity or surface energy. The functional particles may be a combination of plural kinds of particles.

Examples of the particles imparting conductivity (conductive particles) include metals and metal alloys (for example, carbon black, graphite, aluminum, nickel, and copper alloy), metallic oxides (for example tin oxide, zinc oxide, potassium titanate, complex oxide such as tin oxide-indium oxide or tin oxide-antimony oxide), nitrides (for example, aluminum nitride, boron nitride, and titanium nitride), and alkali metals and compounds thereof (for example, hydrogen sulfate magnesium, barium sulfate, tungsten, molybdenum, and vanadium).

Examples of the particles imparting magnetism include gadolinium oxide, magnetite, maghematite, various kinds of ferrite (for example, MnZn ferrite, NiZn ferrite, Yfe garnet, GaFe garnet, Ba ferrite, and Sr ferrite), metals and metal alloys (for example, iron, manganese, cobalt, nickel, chromium, gadolinium, and alloys thereof). The particles imparting magnetism are preferably composed of magnetite or maghematite having high biocompatibility.

Examples of the particles imparting mechanical strength include titanium oxide, porous polyimide, insulating carbon black, silica, kaolin, clay, silicon carbide, silicon nitride, aluminum oxide, magnesium oxide, barium sulfate, tin oxide, cerium oxide, antimony-doped tin oxide, tin-doped indium oxide, zinc antimonate, titanium oxide, aluminum borate, potassium titanate, strontium titanate, calcium silicate, basic magnesium sulfate, nylon, polyester, aramid, and carbon nanotube.

Examples of the particles controlling hydrophilicity/hydrophobicity include silica oxide and aluminum oxide.

Examples of the particles controlling surface energy include inorganic particles (for example, molybdenum disulfide, graphite, precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, aluminium hydroxide, alumina, lithopone, zeolite, hydrated halloysite, magnesium carbonate, and magnesium hydroxide), organic resin particles (for example, styrenic resin particles, acrylic resin particles, microcapsules, urea resin particles, olefin polymer particles of polyethylene, polypropylene, or copolymers containing these polymers, fluorine polymer particles such as polytetrafluoroethylene (PTFE), silicon resin particles, nylon particles, and melamine resin particles).

Examples of the apparatus for dispersing the functional particles in the coating liquid include a colloid mill, a flow jet mill, a slasher mill, a high-speed disperser, a ball mill, an attritor, a sand mill, a sand grinder, an ultrafine mill, an EIGER motor mill, a DYNO mill, a PEARL mill, an agitator mill, a COBALL mill, a triple roll mill, a double roll mill, an extruder, a kneader, a microfluidizer, a laboratory homogenizer, an ultrasound homogenizer, and a jet mill. These apparatuses may be used alone or in combination.

The resin material may be freely selected. Examples of the resin include a polyimide resin, a polyamide resin, a polyamide imide resin, a polyether ether ester resin, a polyalylate resin, a polyester resin, silicone rubber, an urethane resin, an epoxy resin, a phenolic resin, an acrylonitrile-butadiene-styrene copolymer (ABS), a thermoplastic elastomer, a styrene-isoprene-styrene block copolymer, a styrene-ethylene-propylene-styrene block copolymer, a styrene-ethylene-butylene-styrene block copolymer, a styrene-butadiene-styrene block copolymer, styrene-butadiene rubber, a styrene-butadiene copolymer, an acrylonitrile-styrene copolymer, a polyvinyl pyrrolidone resin, a polyvinyl alcohol resin, a polyvinyl methyl ether resin, a polyvinyl isobutyl ether resin, a polyvinyl formal resin, a polyvinyl butyral resin, a polyvinyl acetate resin, a polytrimethylene terephthalate resin, a polysulfone resin, a polysulfone resin, a polystyrene resin, a polyphenylene sulfide resin, a polyphenylene ether resin, a polypropylene resin, a polyphthalamide resin, a poly(oxymethylene) resin, a polymethylpentene resin, a polymethyl methacrylate resin, a polymethacrylonitrile resin, a polymethoxy acetal resin, a polyisobutylene resin, a polyethylene terephthalate resin, a polyethersulfone resin, a polyethylene naphthalate resin, a polyether nitrile resin, a polyether imide resin, a polyether ether ketone resin, a polyethylene resin, a polycarbonate resin, a polybutylene terephthalate resin, a polybutadiene styrene resin, polyparaphenylene benzobisoxazole resin, a poly-N-butyl methacrylate resin, a polybenzimidazole resin, a polybutadiene acrylonitrile resin, a polyarylate resin, a polyacrylonitrile resin, a polyacrylic acid resin, natural rubber, nitrile rubber, a methyl methacrylate butadiene styrene copolymer, isoprene rubber, butyl rubber, a furan resin, an ethylene-vinyl alcohol copolymer, an ethylene-vinyl acetate copolymer, an ethylene-propylene-diene terpolymer, a cellulose propionate resin, hydrin rubber, a carboxymethyl cellulose resin, a cresol resin, a cellulose acetate propionate resin, a cellulose acetate butylate resin, a cellulose acetate resin, a bismaleimide triazine resin, cis-1,4-polybutadiene synthetic rubber, an acrylonitrile-styrene acrylate resin, an acrylonitrile-styrene copolymer, an acrylonitrile-ethylene-propylene-styrene copolymer, acrylate rubber, and polylactic acid. The resin material contained in the coating liquid may be a resin precursor as in the case of a polyimide resin.

Among these resin materials, a polyimide resin is particularly preferred because it has a high mechanical strength, and good heat resistance and insulating properties.

A polyimide resin is usually produced by polymerizing equimolar amounts of tetracarboxylic dianhydride or its derivative and a diamine in a solvent to obtain a solution of a polyamic acid (resin precursor), and then heating and calcining the polyamic acid to cause imidization. Examples of the tetracarboxylic dianhydride include the one represented by the formula (I):

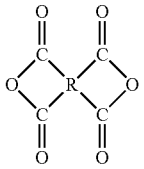

(I)

In the formula (I), R represents a tetravalent organic group, and is an aromatic, aliphatic, or cyclic aliphatic group, a combination of aromatic and aliphatic groups, or a substituted derivative thereof.

Specific examples of the tetracarboxylic dianhydride include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride, and ethylenetetracarboxylic dianhydride.

Specific examples of the diamine include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenyl sulfone, 1,5-diaminonaphthalene, m-phenylenediamine, p-phenylenediamine, 3,3'-dimethyl-4,4'-biphenyldiamine, benzidine, 3,3'-dimethyl benzidine, 3,3'-dimethoxybenzidine, 4,4'-diaminodiphenylsulfone, 4,4'-diaminodiphenylpropane, 2,4-bis(β-amino-tertiary-butyl)toluene, bis(p-β-amino-tertiary-butylphenyl)ether, bis(p-β-methyl-δ-aminophenyl)benzene, bis-p-(1,1-dimethyl-5-amino-pentyl) benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

The solvent used for the polymerization of tetracarboxylic dianhydride and a diamine is preferably a polar solvent (organic polar solvent) in terms of solubility and the like. The polar solvent is preferably a N,N-dialkylamides, and specific examples thereof include low molecular weight N,N-dialkylamides such as N,N-dimethylformamide, N,N-dimethylacetamide, N,N-diethylformamide, N,N-diethylacetamide, N,N-dimethylmethoxyacetamide, dimethylsulfoxide, hexamethylphosphortriamide, N-methyl-2-pyrrolidone, pyridine, tetramethylenesulfone, and dimethyltetramethylenesulfone. These solvents may be used alone or in combination of two or more thereof.

The solvent used herein is preferably a polar solvent (organic polar solvent) in terms of solubility. The polar solvent is preferably a N,N-dialkylamides, and specific examples thereof include low molecular weight N,N-dialkylamides such as N,N-dimethylformamide, N,N-dimethylacetamide, N,N-diethylformamide, N,N-diethylacetamide, N,N-dimethylmethoxyacetamide, dimethylsulfoxide, hexamethylphosphortriamide, N-methyl-2-pyrrolidone, pyridine, tetramethylenesulfone, and dimethyltetramethylenesulfone. These solvents may be used alone or in combination of two or more thereof.

The solvent is not limited to the above examples, but may be selected according to the resin to be used.

The eluting solvent is described.

The eluting solvent is used for eluting the resin material. Therefore, the eluting solvent is selected from solvents which dissolve the resin material. When a solvent dissolves a resin material, it means that 10 wt % or more of the resin solid content is soluble in the solvent at 25° C.

Specific examples of the eluting solvent include those used in the coating liquid containing the functional particles and resin material. It is preferred that the eluting solvent is identical with the solvent contained in the coating liquid.

The above-described method for manufacturing a resin film according to the present exemplary embodiment is useful for the manufacture of, for example, antistatic films for electronic components, anisotropic conductive films for IC substrates, and PS plates (lithographic plates) according to the type of the functional particles contained in the film.

-Second Exemplary Embodiment- (Transfer Belt: Tubular Body)

Figure 3:
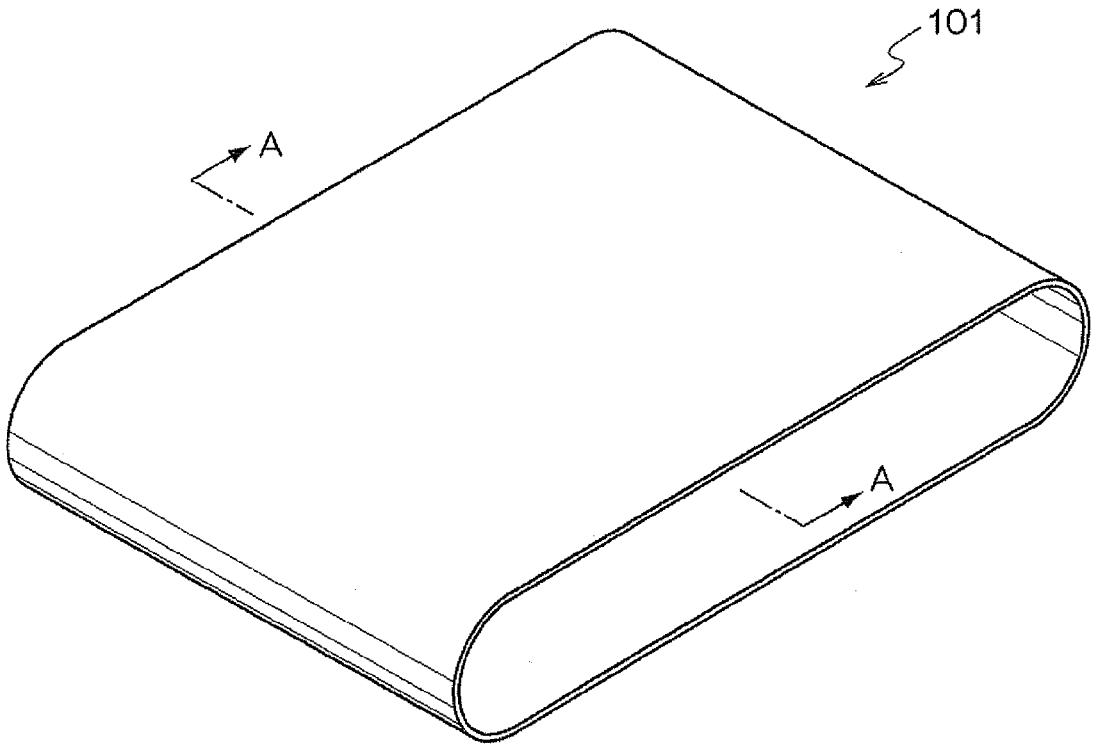
FIG. 3 is a schematic perspective view showing a transfer belt according to a second exemplary embodiment.
Figure 4:
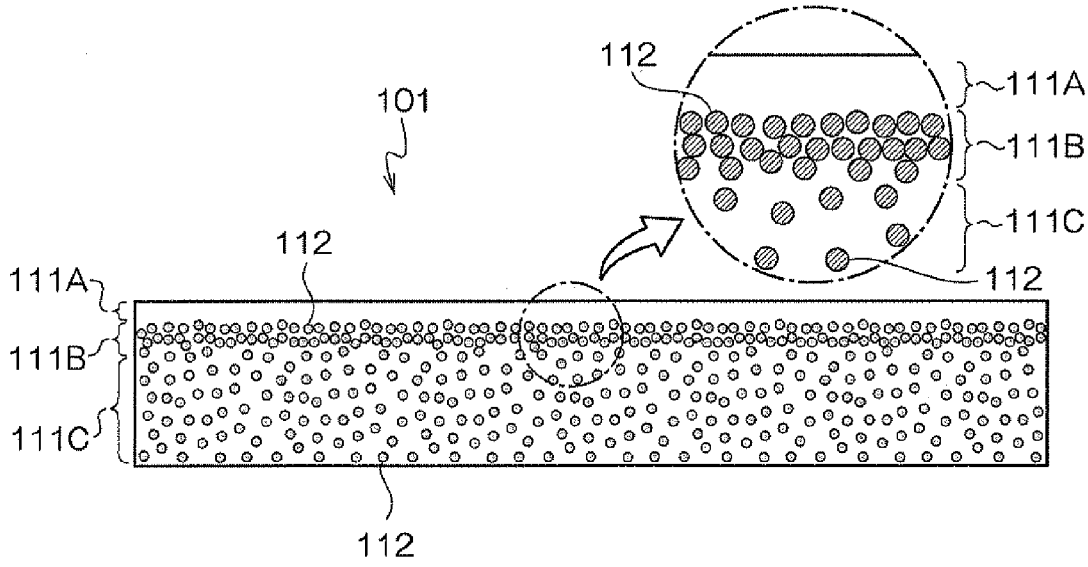
FIG. 4 is a schematic cross sectional view showing an A-A cross section of FIG. 3.

FIG. 3 is a schematic perspective view showing a transfer belt according to a second exemplary embodiment. FIG. 4 is a schematic cross sectional view showing an A-A cross section of FIG. 3.

A transfer belt 101 according to the present exemplary embodiment is endless as shown in FIGS. 3 and 4, and is formed of a tubular body consisting of a single base material layer containing at least a resin and conductive particles. The transfer belt 101 according to the present exemplary embodiment is formed of a single layer, but may include another functional layer(s) on the outer or inner peripheral surface of the belt.

The transfer belt 101 according to the present exemplary embodiment includes a particle-free resin region 111A (first region) which is free of the conductive particles 112 and which is provided at the outermost surface; a particle-localized resin region 111B (second region) which contains the conductive particles 112 in a localized state and which is provided closer to the innermost surface than the particle-free resin region 111A; and a particle-containing resin region 111C (third region) which contains the conductive particles 112 at a lower particle density than the particle-localized resin region 111B and which is provided closer to the innermost surface than the particle-localized resin region 111B. The particle-localized resin region 111B contains the conductive particles 112 at a higher density than the particle-containing resin region 111C, and has a higher conductivity than other regions particle-free resin region 111A and particle-containing resin region 111C). Each of these regions is provided in the form of layer along the circumferential direction of the belt.

It is assumed that the decrease of electrical resistance of the belt is caused by the deterioration of the conductive particles and the resin surrounding them through the repeated discharge from the conductive particles (for example, discharge caused by removal of the recording medium from the belt). Detailed analysis of the outermost surface of the belt has shown that projections derived from conductive particles are present in the areas where the decrease of electrical resistance occurs. Electrical resistance more noticeably decreases with the increase of surface resistance. On the other hand, the decrease of surface resistance (that is, the increase of conductivity of the belt surface) requires the addition of a large amount of conductive particles to the belt, which results in the decrease of surface resistance and decrease of volume resistance.

On the other hand, in the transfer belt 10 according to the present exemplary embodiment, the particle-free resin region 111A (first region) free of the conductive particles and provided at the outermost surface decreases the asperities on the outermost surface, that is, decreases the projections derived from the conductive particles 112, thus decreasing the points from which the decrease of electrical resistance occurs. The particle-localized resin region 111B having higher conductivity than other regions (particle-free resin region 111A and particle-containing resin region 111C) and provided closer to the innermost surface than the particle-free resin region 111A decreases surface resistance while preventing the decrease of volume resistance.

In addition, in the surface layer region at the outermost surface (that is, the particle-free resin region 111A (first region)), even if the resin is degraded to form points having low resistance, few conductive particles are present in the surface layer region at the outermost surface, so that the rate of change in conductivity is very small, and substantial resistance change is negligible.

Accordingly, in the transfer belt 101 according to the present exemplary embodiment, the change in electrical resistance is small. As a result of this, image defects due to the change in electrical resistance caused by repeated use are prevented. Examples of such defects include defective transfer caused by the failure to form an electric field necessary for effectively transferring the toner.

In addition, in the transfer belt 101 according to the present exemplary embodiment, the particle-free resin region 111A has a thickness of 0.5 μm or more and 3 μm or less, preferably 0.5 μm or more and 1.5 μm or less, thereby serving as a protective layer of the belt, and smoothening the belt surface. If the thickness of the particle-free resin region 111A is too small, it is difficult to prevent the decrease of electrical resistance. On the other hand, if the thickness of the particle-free resin region 111A is too great, the outermost surface of the belt becomes too insulative, which results in the excessive increase of surface resistance and volume resistance.

The particle-free resin region 111A and the particle-localized resin region 111B are preferably arranged in the region from the outermost surface to a depth of approximately 15 μm (preferably 10 μm) in the thickness direction. In addition, conductivity of the particle-localized region is five times or more higher, preferably five times or more and 100 times or less, and even more preferably five times or more and 50 times or less in comparison with that of the particle-containing resin region 111C provided deeper than the range from the outermost surface to a depth of approximately 15 μm (preferably 10 μm).

This means that the maximum electric current flowing through the region extending from the outermost surface to a depth of approximately 15 μm in the thickness direction (that is, the maximum electric current flowing through the particle-localized resin region 111B) is greater than the maximum electric current flowing through the region provided beyond a depth of approximately 15 μm in the thickness direction from the outermost surface to the innermost surface (that is, the maximum electric current flowing through the particle-containing resin region 111C). When the above-described relationship of the conductivity (maximum electric current values) is satisfied, a low surface resistance is achieved while the decrease of volume resistance is prevented.

The presence or absence of the conductive particles 112 in the particle-free resin region 111A, particle-localized resin region 111B, and particle-containing resin region 111C may be confirmed on the basis of direct observation of the particles contained in a section of the belt, which has been sliced by focused ion beam (FIB), by a transmission electron microscope, or on the basis of height information on a section, which has been sliced by a microtome, obtained with an atomic force microscope (AFM).

The conductivity of the region between the outermost surface and a depth of approximately 15 μm in the thickness direction and the conductivity of the region provided beyond a depth of approximately 15 μm in the thickness direction from the outermost surface to the innermost surface are compared on the basis of AFM observation of a belt section, which has been prepared using a microtome, in a conducting mode. Specifically, the maximum current in each regions is measured in a 10 μm square of a section (sample) of the belt using D3000 and NANOSCOPE III manufactured by Digital Instruments under following conditions of measurement mode: contact mode, cantilever: Au-coated conductive cantilever, spring constant: 0.2 N/m, and applied voltage: −5 V.

The section (sample) of the belt is sliced from the embedded belt using a microtome, a silver paste electrode is bonded in parallel to the sample depth direction, and used as the counter electrode of the cantilever. The belt section (sample) is observed in an area of 10 μm square, and the electric current value (conductivity) and height information are obtained.

The above-described conditions are only one example and shall not be taken as limiting. The measurement range, applied voltage, and spring constant may be optionally changed according to the belt section (sample).

The maximum current determined by the above-described method is used to compare the electric conductivity.

The transfer belt 101 according to the present exemplary embodiment is further described below regarding its constituent materials and properties.

Firstly, the resin (hereinafter referred to as resin material) is described.

The Young's modulus of the resin material varies depending on the belt thickness, and is preferably 3500 MPa or more, more preferably 4000 MPa or more so as to exhibit sufficient machine properties of the belt. The resin may be any one as long as it has the above-described Young's modulus. Examples of the resin include a polyimide resin, a polyamide resin, a polyamide imide resin, a polyether ether ester resin, a polyarylate resin, a polyester resin, and a reinforced polyester resin.

The Young's modulus is determined by a tensile test in accordance with JIS K 7127 (1999); a tangent is drawn to the curve in the initial strain region of the stress-strain curve obtained, and the Young's modulus is determined from the decline of the tangent. The measurement is carried out under the following conditions of strip specimen (width, 6 mm; length, 130 mm), No. 1 dumbbell, and test speed 500 mm/minute, and that the thickness is a belt body thickness.

Among the above-described resin materials, a polyimide resin is preferred. Since a polyimide resin is a material having a high Young's modulus, it is less deformed during driving (under stress of a supporting roll or a cleaning blade) than other resins, and thus provides a transfer belt giving less image defects such as mis color registration. A polyimide resin is usually produced by polymerizing equimolar amounts of tetracarboxylic dianhydride or its derivative and a diamine in a solvent to obtain a solution of a polyamic acid. Examples of the tetracarboxylic dianhydride include the one represented by the formula (I):

(I)

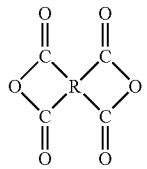

In the formula (I), R represents a tetravalent organic group, and is an aromatic, aliphatic, or cyclic aliphatic group, a combination of aromatic and aliphatic groups, or a substituted derivative thereof.

Specific examples of the tetracarboxylic dianhydride include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride, and ethylenetetracarboxylic dianhydride.

Specific examples of the diamine include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenyl sulfone, 1,5-diaminonaphthalene, m-phenylenediamine, p-phenylenediamine, 3,3'-dimethyl-4,4'-biphenyldiamine, benzidine, 3,3'-dimethyl benzidine, 3,3'-dimethoxybenzidine, 4,4'-diaminodiphenylsulfone, 4,4'-diaminodiphenylpropane, 2,4-bis(β-amino-tertiary-butyl)toluene, bis(p-β-amino-tertiary-butylphenyl)ether, bis(p-β-methyl-δ-aminophenyl)benzene, bis-p-(1,1-dimethyl-5-amino-pentyl) benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

The solvent used for the polymerization of tetracarboxylic dianhydride and a diamine is preferably a polar solvent (organic polar solvent) in terms of solubility and the like. The polar solvent is preferably a N,N-dialkylamides, and specific examples thereof include low molecular weight N,N-dialkylamides such as N,N-dimethylformamide, N,N-dimethylacetamide, N,N-diethylformamide, N,N-diethylacetamide, N,N-dimethylmethoxyacetamide, dimethylsulfoxide, hexamethylphosphortriamide, N-methyl-2-pyrrolidone, pyridine, tetramethylenesulfone, and dimethyltetramethylenesulfone. These solvents may be used alone or in combination of two or more thereof.

The solid concentration of the polyamic acid solution is preferably 5% by weight or more and 40% by weight or less, and more preferably 10% by weight or more and 30% by weight or less. When the solid concentration is 40% by weight or less, the solution is readily applied so as to form a uniform coating film. In addition, when the solid concentration is 5% by weight or more, the coating film readily has a thickness giving a sufficient strength. The viscosity of the polyamic acid solution is not particularly limited, but is usually 1 Pa·s or more and 500 Pa·s or less so as to give good processability.

The conductive particles are described below.

The conductive particles may be conductive or semiconductive powder. The conductivity is not particularly limited as long as the belt stably achieves certain electrical resistance. Examples of the conductive particles include ketjen black, acetylene black, carbon black such as oxidized carbon black having a pH of 5 or less, metals such as aluminum or nickel, oxidized metal compounds such as tin oxide, and potassium titanate. These particles may be used alone or in combination. Among them, carbon black is preferred due to its cost advantage. The term "conductive" means that the particles have a volume resistivity of less than $10^7$ Ωcm. The term "semiconductive" means that the particles have a volume resistivity of $10^7$ or more and $10^{13}$ Ωcm or less. Hereinafter the same shall apply.

Two or more carbon blacks may be used. These carbon blacks preferably have substantially different conductivity. These carbon blacks have different physical properties such as a specific surface area as determined by, for example, the degree of oxidation, DBP oil absorption, or a BET method using nitrogen adsorption (a method for calculating the surface area of 1 g on the basis of the amount of adsorbed nitrogen). The DBP oil absorption (cc/100 g) represents the amount of dibutyl phthalate (DBP) absorbed in 100 g of carbon black, and is defined in ASTM (American Society for Testing and Materials) D2414-6TT. The BET method is defined in JIS 6217.

When two or more carbon blacks having different conductivities are used, the surface resistivity may be controlled by, for example, adding one carbon black having higher conductivity first, and then the other one having lower conductivity. When two or more carbon blacks are used as described above, at least one of them is preferably oxidized carbon black thereby increasing miscibility and dispersibility between the carbon blacks.

The properties of the transfer belt according to the present exemplary embodiment are described below.

When the transfer belt according to the present exemplary embodiment is an intermediate transfer belt, the surface resistivity of the outer peripheral surface is preferably 9 (Log Ω/□) or more and 13 (Log Ω/□) or less in terms of common logarithm, and more preferably 10 (Log Ω/□) or more and 12 (Log Ω/□) or less. If the common logarithm of the surface resistivity is greater than 13 (Log Ω/□) after voltage application for 30 msec, the recording medium electrostatically may adsorb to the intermediate transfer belt during secondary transfer, which hinders removal of the recording medium. On the other hand, if the common logarithm of the surface resistivity is less than 9 (Log Ω/□) after voltage application for 30 msec, the toner image primarily transferred to the intermediate transfer belt may have insufficient retentivity, which results in uneven image graininess or image disorder. The common logarithm of the surface resistivity is controlled by the type and amount of the below-described conductive agent.

Figure 5A:
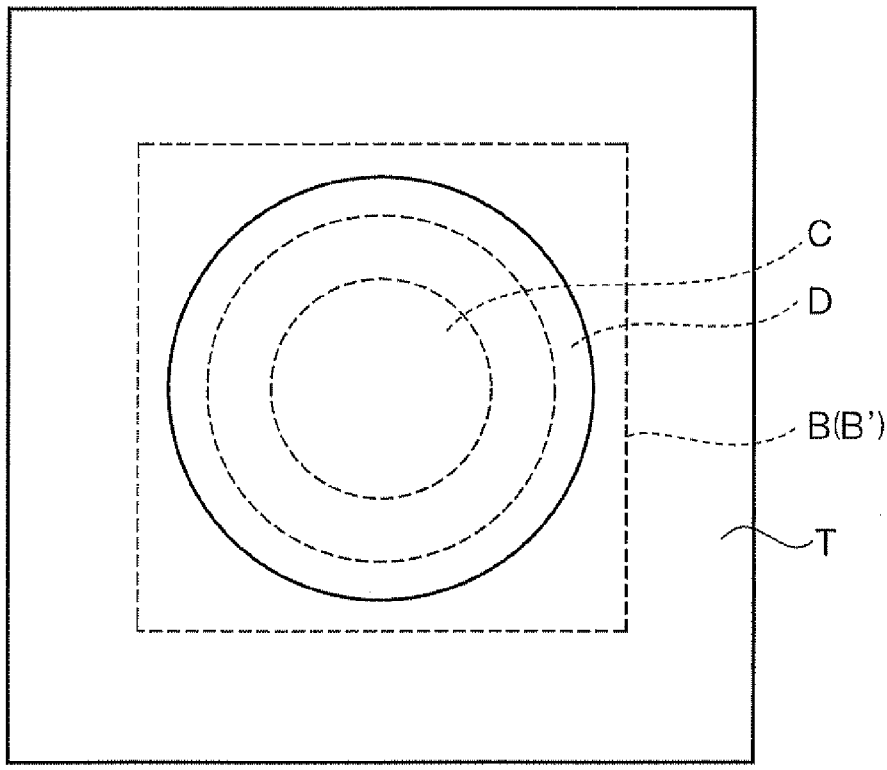
FIG. 5A is a schematic plan view showing one example of a circular electrode.
Figure 5B:
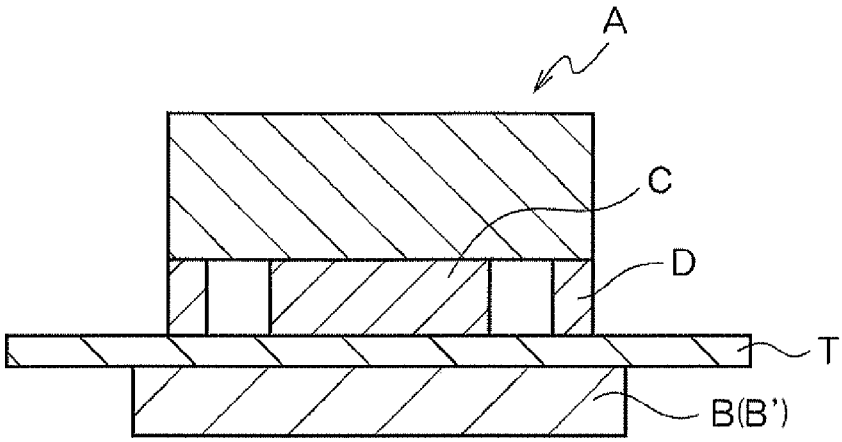
FIG. 5B a schematic cross sectional view showing one example of a circular electrode.

The surface resistivity is measured as follows using a circular electrode (for example, trade name: UR PROBE of HIRESTA IP, manufactured by Mitsubishi Petrochemical Co., Ltd.) in accordance with JIS K6911. The method for measuring the surface resistivity is described below with reference to drawings. FIGS. 5A and 5B are a schematic plan view and a schematic cross sectional view of a circular electrode, respectively. The circular electrode shown in FIGS. 5A and 5B includes a first voltage application electrode A and a plate insulator B. The first voltage application electrode A is provided with a column electrode C and a cylindrical ring electrode D which has an inside diameter greater than the outside diameter of the column electrode C, and surrounds the column electrode C at a certain distance. A belt T is sandwiched between the column electrode C, ring electrode D, and the plate insulator B in the first voltage application electrode A. The electric current I (A) flowing through the belt upon the application of a voltage V (V) between the column electrode C and ring electrode D in the first voltage application electrode A is measured, and the surface resistivity ρs (Ω/□) of the transfer surface of the belt T is calculated according to the following formula:

$$\rho s=\pi\times(D+d)/(D-d)\times(V/I)$$

wherein d (mm) represents the outside diameter of the column electrode C, and D (mm) represents the inside diameter of the ring electrode D.

The surface resistivity is calculated using a circular electrode (trade name: UR PROBE of HIRESTA IP, manufactured by Mitsubishi Petrochemical Co., Ltd., outside diameter of column electrode C: 16 mm, inside diameter of ring electrode D: 30 mm, outside diameter of ring electrode D: 40 mm) on the basis of the electric current value after the application of a voltage of 500 V for 10 seconds in a 22° C./55% RH environment.

When the transfer belt according to the present exemplary embodiment is an intermediate transfer belt, the entire volume resistivity is preferably 8 (Log Ωcm) or more and 13(Log Ωcm) or less in terms of common logarithm. If the volume resistivity is less than 8 (Log Ωcm) in terms of common logarithm, electrostatic force for keeping the charge of the unfixed toner image transferred from the image holder to the intermediate transfer belt is hardly exerted. As a result of this, the toner may be scattered around the image by the electrostatic repulsive force of toner particles and the fringe electric field near the edges of the image to give an image with a big noise. On the other hand, if the volume resistivity is greater than 13 (Log Ωcm) in terms of common logarithm, charge retentivity is so great that the surface of the transfer belt is charged by the transfer electric field formed by the primary transfer, which may result in the necessity for a discharging device. The common logarithm of the volume resistivity is controlled by the type and amount of the below-described conductive agent.

The volume resistivity is measured as follows using a circular electrode (for example, trade name: UR PROBE of HIRESTA IP, manufactured by Mitsubishi Petrochemical Co., Ltd.) in accordance with JIS K6911. The method for measuring the volume resistivity is described below with reference to drawings. The measurement uses the same apparatus as that used for the measurement of surface resistivity, except that the circular electrode shown in FIGS. 5A and 5B includes a second voltage application electrode B' in place of the plate insulator B for measuring the surface resistivity. A belt T is sandwiched between the column electrode C, ring electrode D, and the second voltage application electrode B' in the first voltage application electrode A. The electric current I (A) flowing through the belt upon the application of a voltage V (V) between the column electrode C and the second voltage application electrode B in the first voltage application electrode A is measured, and the volume resistivity ρv (Ωcm) of the belt T is calculated according to the following formula:

$$\rho v=19.6\times(V/I)\times t$$

wherein t represents the thickness of the belt T.

The volume resistivity is calculated using a circular electrode (trade name: UR PROBE of HIRESTA IP, manufactured by Mitsubishi Petrochemical Co., Ltd., outside diameter of column electrode C: 16 mm, inside diameter of ring electrode D: 30 mm, outside diameter of ring electrode D: 40 mm) on the basis of the electric current value after the application of a voltage of 500 V for 10 seconds in a 22° C./55% RH environment.

The value 19.6 in the above formula is an electrode coefficient for converting into resistivity, and is calculated as $\pi d^2/4t$ from the outside diameter d (mm) of the column electrode and the sample thickness t (cm). The thickness of the belt T is measured using an eddy current-type film thickness meter (trade name: CTR-1500E, manufactured by Sanko Electronic Laboratory Co., Ltd.).

Figure 6:
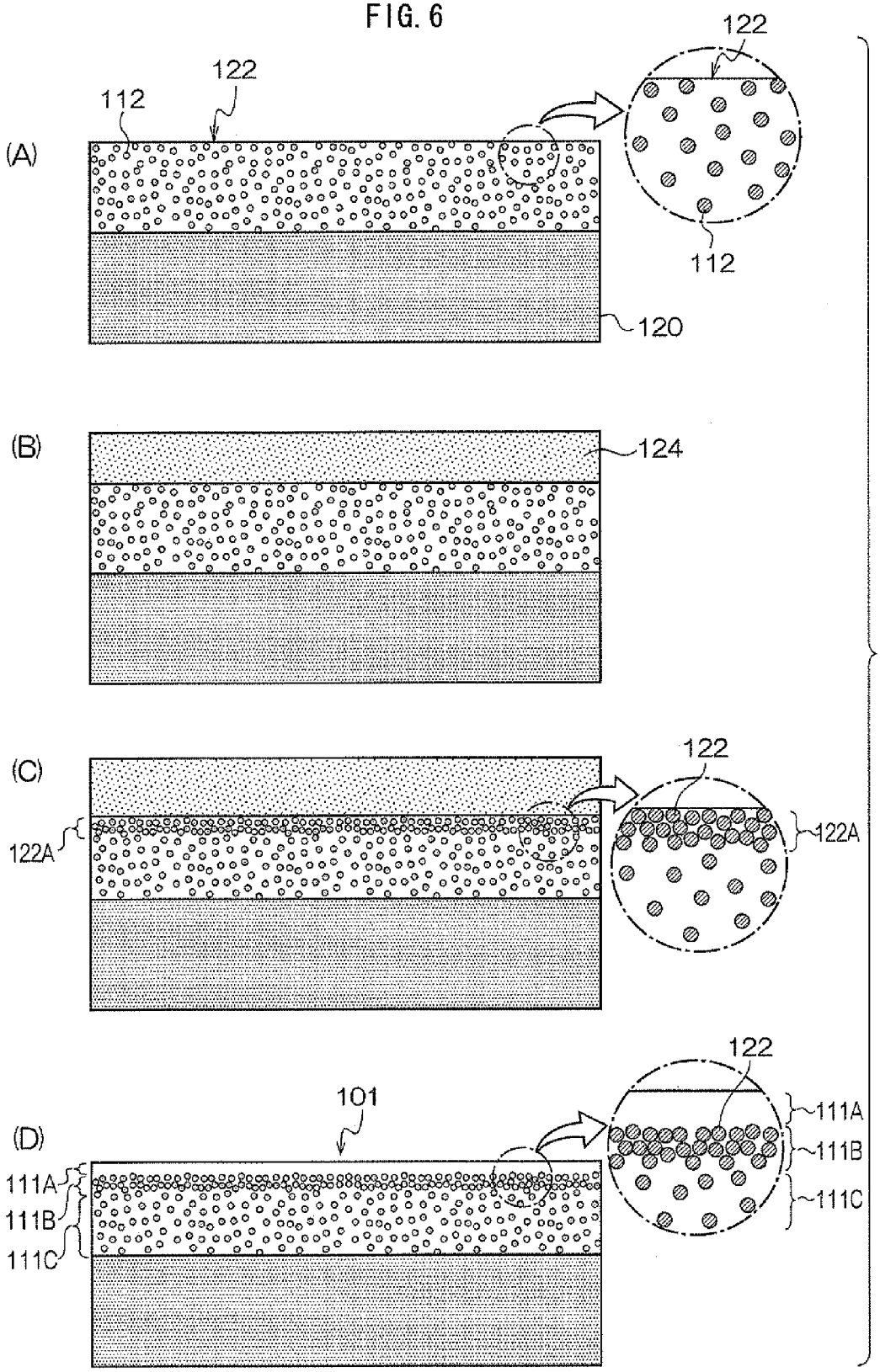
FIG. 6 is a process chart showing a method for manufacturing a transfer belt according to the second exemplary embodiment.

The method for manufacturing a transfer belt according to the present exemplary embodiment is described below. FIG. 6 is a process chart showing the method for manufacturing a transfer belt according to the present exemplary embodiment.

In the method for manufacturing the transfer belt 101 according to the present exemplary embodiment, firstly, a coating liquid containing the conductive particles 112, a resin material, and a solvent is prepared. As shown in FIG. 6(A), the coating liquid is applied to a cylindrical die 120 to form a coating film 122 of the coating liquid.

The method for applying the coating liquid to the cylindrical die 120 is not particularly limited. For example, the outer peripheral surface is immersed in the coating liquid, the coating liquid is applied to the inner peripheral surface, the coating liquid is applied to the inner peripheral surface, followed by rotation of the die, or the coating liquid is charged into an injection die thereby forming an endless coating film 122. Before the belt formation, it is preferred that the die be treated with a releasing agent.

For example, a polyamic acid solution containing dispersed carbon black (conductive particles) is prepared as the coating liquid, but not limited to this. Firstly, purified carbon black is dispersed in an organic polar solvent. It is preferred that preliminary stirring be carried out before dispersion with a disperser or homogenizer. As is the case with the purification of carbon black, contamination with fine media deteriorates the purity of carbon black. Therefore, the dispersion method preferably uses no medium, and is particularly preferably a jet mill capable of dispersing while preventing the unevenness of a high viscosity solution.

The above-described diamine and acid anhydride components are dissolved and polymerized in the dispersion liquid of carbon black obtained as described above, thereby preparing a polyamic acid solution containing dispersed carbon black. At that time, the monomer concentration (the total concentration of the diamine and acid anhydride components in the solvent) is established according to various conditions, but is preferably 5% by weight or more and 30% by weight or less. The reaction temperature is preferably 80° C. or less, particularly preferably 5° C. or more and 50° C. or less. The reaction period is 5 hours or more and 10 hours or less.

The polyamic acid solution containing dispersed carbon black is a highly viscous solution, so that the bubbles included during preparation will not naturally disappear, but cause defects such as projections, depressions, or holes in the belt upon application of the solution. Therefore the solution is preferably subjected to deaeration. Therefore, deaeration is preferably carried out immediately before the application of the solution.

Subsequently, the coating film 122 applied to the cylindrical die 120 is dried. The drying operation is carried out such that the proportion of residual solvent in the coating film 122 is 25% or less, preferably 20% or less, and more preferably 15% or less. If the proportion of residual solvent in the coating film 122 is too high, the below-described localization (increase of density) of the conductive particles 112 hardly occurs. The lower the proportion of residual solvent, the more readily the below-described localization (increase of density) of the conductive particles 112 occurs. The control of the proportion of residual solvent in the coating film 122, or the dry state of the coating film 122 allows the control of the below-described degree of localization (congestion) of the conductive particles 112, and the location of the region containing localized conductive particles 112 (particle-localized resin layer 111B) in the thickness direction of the transfer belt 111 to be produced.

The proportion of residual solvent refers to the proportion of the solvent weight remaining in the dried coating film with reference to the solvent weight contained in the coating liquid to be applied. The proportion of residual solvent is determined as described below.

For example, when the weight of the solid resin material (dry weight of resin material) and the weight of the functional particles are known, the total weight of the undried coating film is accurately measured, whereby the solvent weight contained in the total weight of the coating film is calculated. Then, the total weight of the dried coating film is accurately measured, the decrement is calculated as the weight of dissipated solvent by the formula: (weight of undried coating film−weight of dried coating film)/(weight of undried coating film−weight of solid resin−weight of functional particles), thereby determining the proportion of residual solvent.

The proportion of residual solvent may be determined using a thermal extraction gas chromatograph-mass spectrograph. An example of the measurement is described below. For example, a portion of the dried coating film is cut out with a weight of about 2 mg or more and 3 mg or less to make a sample, the sample is weighed, and heated to 400° C. in a thermal extraction apparatus (trade name: PY2020D, manufactured by Frontier Laboratories Ltd.). The volatile components are injected into a gas chromatograph-mass spectrograph by way of an interface at 320° C. (trade name: GCMS-QP2010, manufactured by Shimadzu Co., Ltd.), and the quantity is determined. More specifically, helium gas as a carrier gas is injected in an amount of 1/51 (split ratio, 50:1) of the amount of evaporation from the sample into a column (trade name: capillary column UA-5, manufactured by Frontier Laboratories Ltd.) having an inside diameter of 0.25 μm and a length of 30 m at a linear velocity of 153.8 cm/second (carrier gas flow rate of 1.50 ml/minute and pressure of 50 kPa at column temperature of 50° C.). The column is kept at 50° C. for 3 minutes, and then the column temperature is increased to 400° C. at a ratio of 8° C./minute, and the temperature is kept for 10 minutes, thereby desorbing the volatile components. Further, the volatile components are injected into the mass spectrograph at an interface temperature of 320° C., and the peak area corresponding to the solvent is determined. The quantitative determination is carried out on the basis of an analytical curve prepared using the same solvent in known amounts. The determined solvent weight is divided by the weight of the dried sample, thereby calculating the proportion of residual solvent. The above-described procedure of measurement is one example, and the conditions may be changed according to the temperature at which the resin is decomposed or changed, or the boiling point of the solvent.

Then, as shown in FIG. 6(B), an eluting solvent 124 for eluting the resin material is applied to the surface of the dried coating film 122. In the region coated with the eluting solvent 124, the eluting solvent 124 permeates through the dried coating film 122 to swell the region below the coated surface of the coating film 122. At this time, the amount of the eluting solvent 124 on the coated surface of the coating film 122 is greater, that is, the solvent concentration is higher than that in the region below the coated surface of the coating film 122, so that the resin material is more readily eluted into the portion of the eluting solvent 124 on the coated surface of the coating film 122.

As shown in FIG. 6(C), since the conductive particles 112 will not dissolve in the eluting solvent 124, the density of the conductive particles 112 in the region where the resin materials has dissolved increases with the elution of the resin material and becomes greater than that in the other regions. As a result, a region containing the conductive particles 112 in a localized state is formed. In FIG. 6(C), 122A represents the region where the conductive particles 112 are localized.

The eluting solvent is described.

The eluting solvent 124 is used for eluting the resin material. Therefore, the eluting solvent is selected from solvents which dissolve the resin material. When a solvent dissolves a resin material, it means that 10 wt % or more of the resin solid content is soluble in the solvent at 25° C.

The eluting solvent is preferably the same solvent with that contained in the coating liquid. For example, when the coating liquid is a polyamic acid solution, the solvent may be a polar solvent. Preferred examples of the polar solvent include N,N-dialkylamides, and specific examples thereof include low molecular dialkylamides such as N,N-dimethylformamide, N,N-dimethylacetamide, N,N-diethylformamide, N,N-diethylacetamide, N,N-dimethylmethoxyacetamide, dimethylsulfoxide, hexamethylphosphortriamide, N-methyl-2-pyrrolidone, pyridine, tetramethylene sulfone, and dimethyltetramethylene sulfone. These compounds may be used alone or in combination of two or more thereof.

The coating weight of the eluting solvent 124 is, for example, 0.001 g/cm$^2$ or more and 1 g/cm$^2$ or less, preferably 0.01 g/cm$^2$ or more and 1 g/cm$^2$ or less, and more preferably 0.01 g/cm$^2$ or more and 0.5 g/cm$^2$ or less.

The eluting solvent 124 is applied by the method used for applying the coating liquid containing the conductive particles 112 and the resin material.

Thereafter, as shown in FIG. 6(D), the eluting solvent 124 applied to the surface of the coating film 122 is dried. The eluting solvent should be dried such that the proportion of residual solvent is, for example, 10% or less. The proportion of residual solvent is selected in accordance with, for example, the type of the resin material to be used, the intended use of the resin film produced, and the strength and maintainability of the resin film produced.

As described above, the eluting solvent 124 contains the resin material in a dissolved state. Therefore, the resin material deposits on drying of the eluting solvent 124, and forms a layer on the region containing the conductive particles 112 in a localized state. The eluting solvent 124 is free or contains the conductive particles 112 in a lower amount than other region, so that a particle-free resin layer 111A containing no conductive particles 112 is formed on the region containing the conductive particles 112 in a localized state. Then, a particle-localized resin layer 111B containing the conductive particles 112 in a localized state is formed below the particle-free resin layer 111A, and a particle-containing resin layer 16C containing the conductive particles 112 at a lower density is formed below the particle-localized resin layer 111B. The particle-free resin layer 111A normally contains no particle, but may contain some particles migrated from the conductive particles 112 into the eluting solvent 124.

Through the above-described process, the transfer belt 101 including the three regions having different particle densities (particle-free resin region 111A, particle-localized resin region 111B, and particle-containing resin region 111C) is obtained.

When the resin material is a resin precursor such as a polyimide resin (polyamic acid solution), the eluting solvent 124 is dried, and then calcined to produce the transfer belt 101. The calcination, more specifically conversion of polyamide into imide is usually carried out at a high temperature of 200° C. or more. If the temperature is below 200° C., sufficient imide conversion will not be achieved. On the other hand, high temperature treatment favors imide conversion, and provides stable properties. However, the use of heat energy deteriorates thermal efficiency and increases the cost, so that the heat treatment temperature must be selected in consideration of the properties and productivity of the transfer belt.

(Transfer Unit)

Figure 7:
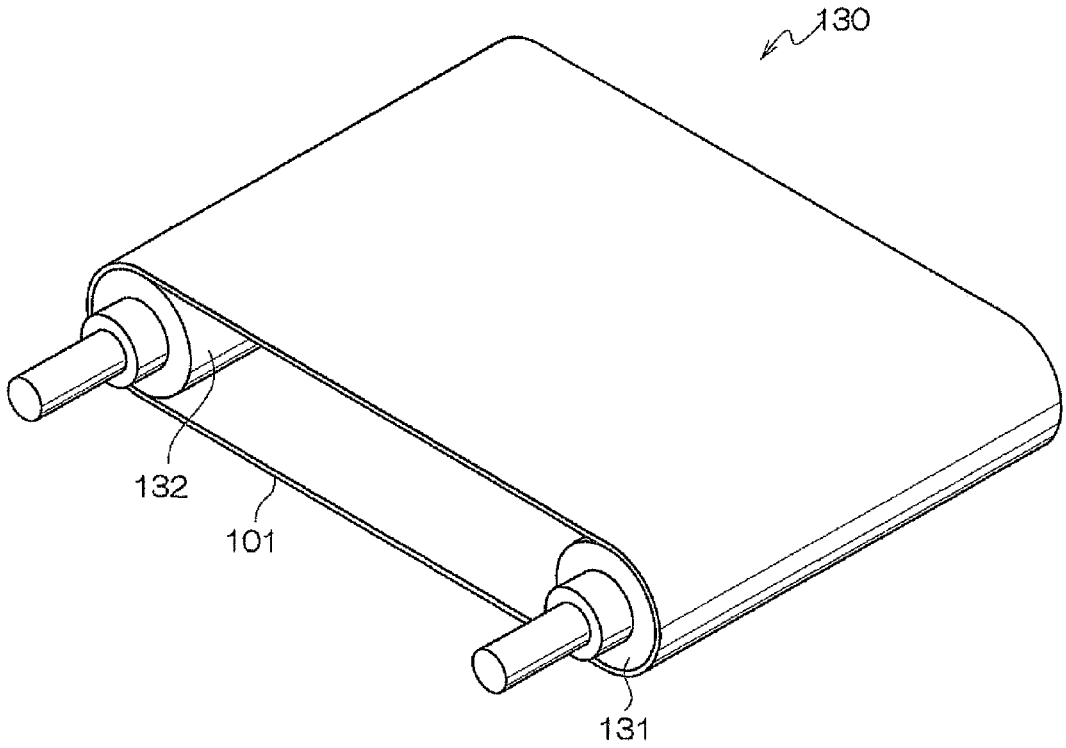
FIG. 7 is a schematic perspective view showing a transfer unit according to the second exemplary embodiment.

FIG. 7 is a schematic perspective view showing a transfer unit according to the present exemplary embodiment. As shown in FIG. 7, a transfer unit 130 according to the present exemplary embodiment includes the transfer belt 101 according to the above-described exemplary embodiment, and the transfer belt 101 is wrapped under tension (hereinafter may be referred to simply as merely "stretched") around a driving roll 131 and a driven roll 132, which are arranged opposed to each other. In addition, though not shown, a roll for primarily transferring the toner image from the surface of a photoreceptor (image holder) to the transfer belt 101, and another roll for secondarily transferring the toner image from the transfer belt 101 to a recording medium are provided. The number of rolls for stretching the transfer belt 101 is not particularly limited, and may be any number according to the status of use. The transfer unit 130 having the above structure is incorporated into the image forming apparatus, and the transfer belt 101 is rotated in a stretched state along with the rotation of the driving roll 131 and driven roll 132 during image formation.

(Image Forming Apparatus)

The image forming apparatus according to the present exemplary embodiment includes an image holder; a charging unit that charges the surface of the image holder; a latent image forming unit that forms a latent image on the surface of the image holder; a development unit that develops the latent image with a toner into a toner image; a transfer unit that transfers the toner image to a recording medium; and a fixing unit that fixes the toner image on the recording medium, the transfer unit having a transfer belt according to the present exemplary embodiment.

More specifically, the image forming apparatus according to the present exemplary embodiment may include a transfer unit composed of an intermediate transfer belt, a primary transfer unit that primarily transfers the toner image formed on the image holder to the intermediate transfer belt, and a secondary transfer unit that secondarily transfers the toner image from the intermediate transfer belt to a recording medium, the intermediate transfer belt being the transfer belt according to the present exemplary embodiment.

Alternatively the image forming apparatus according to the present exemplary embodiment may include a transfer unit composed of a conveyor/transfer belt that carries a recording medium, and a transfer device that transfers the toner image formed on the image holder to the recording medium transferred by the conveyor/transfer belt, the transfer belt that carries the recording medium being the transfer belt according to the present exemplary embodiment.

The image forming apparatus according to the present exemplary embodiment may be, for example, an ordinary monocolor image forming apparatus composed of a development device containing a single color toner, a color image forming apparatus wherein toner images held on an image holder are sequentially subjected to primary transfer to an intermediate transfer belt, or a tandem type color image forming apparatus wherein plural image holders having different color developing devices are arranged in tandem on an intermediate transfer belt.

Figure 8:
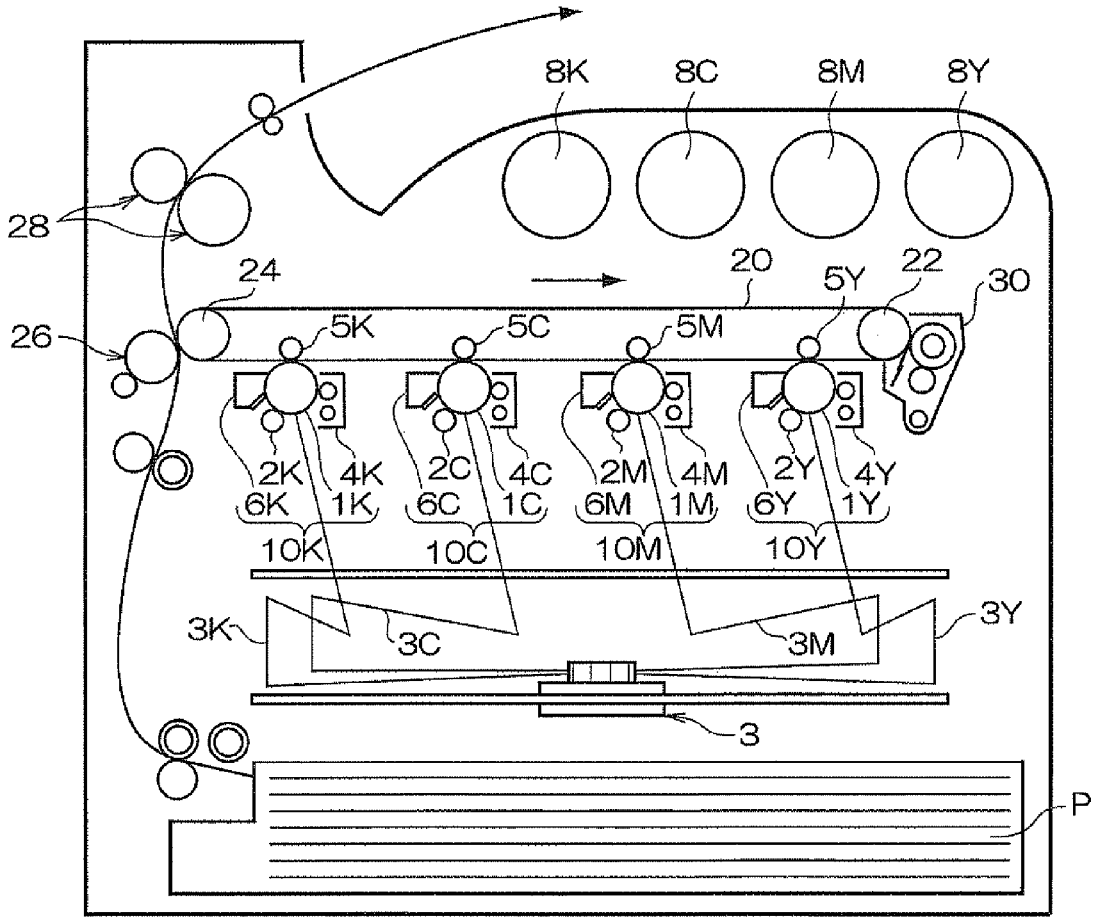
FIG. 8 is a schematic structural view showing an image forming apparatus according to the second exemplary embodiment.
Figure 9:
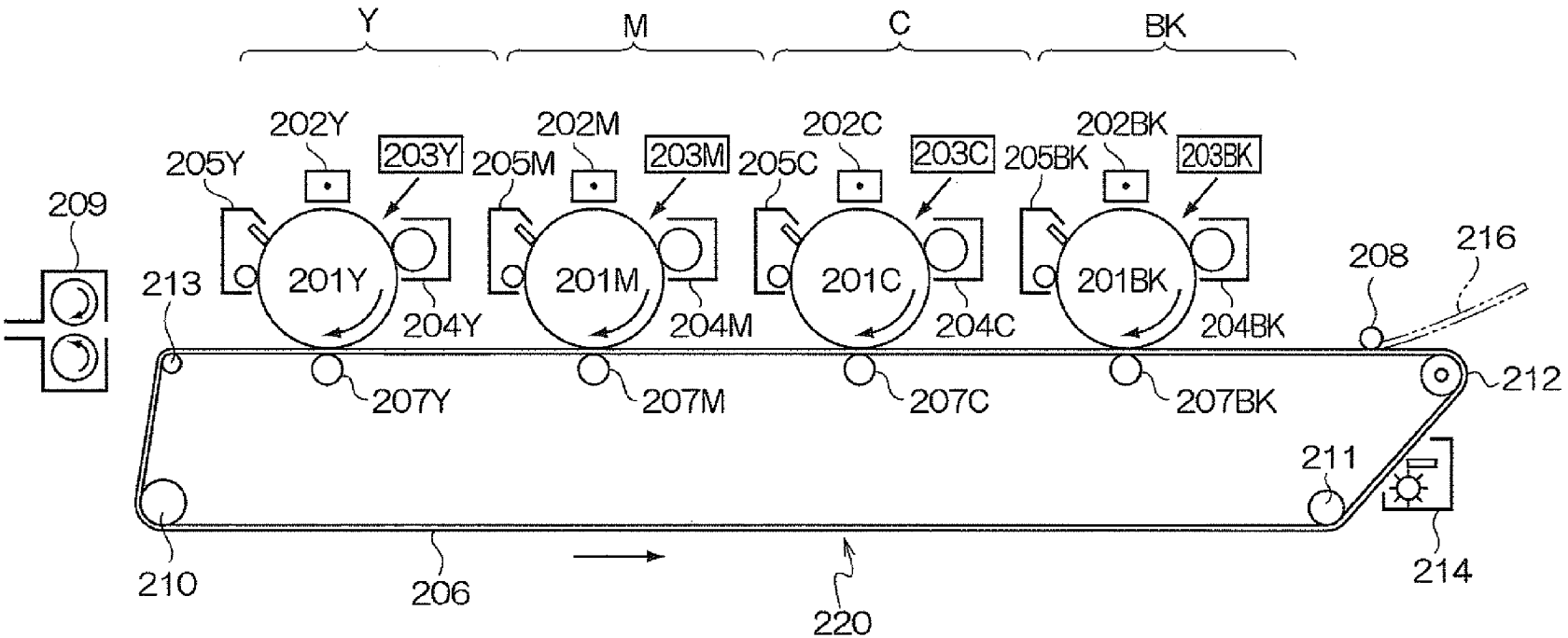
FIG. 9 is a schematic structural view showing an image forming apparatus according to another exemplary embodiment.

The image forming apparatus according to the present exemplary embodiment is further described below with reference to drawings. FIG. 8 is a schematic structural view showing an image forming apparatus according to the present exemplary embodiment. FIG. 9 is a schematic structural view showing an image forming apparatus according to another exemplary embodiment. FIG. 8 shows an image forming apparatus including an intermediate transfer belt, and FIG. 9 shows an image forming apparatus including a recording medium conveyor/transfer belt.

The image forming apparatus shown in FIG. 8 includes first to fourth image forming units 10Y, 10M, 10C, and 10K on electrographic system for outputting yellow (Y), magenta (M), cyan (C), and black (K) color images according to the color-decomposed image data. These image forming units (hereinafter referred to simply as "units") 10Y, 10M, 10C, and 10K are arranged in the horizontal direction with a predetermined between them. These units 10Y, 10M, 10C, and 10K may be process cartridges attachable to and detachable from the body of the image forming apparatus.

In the figure, an intermediate transfer belt 20 is provided above the units 10Y, 10M, 10C, and 10K, the intermediate transfer belt 20 serves as an intermediate transfer medium traveling through these units. The intermediate transfer belt 20 is wrapped under tension around a driving roll 22 and a supporting roll 24, which is arranged horizontally opposed to the driving roll 22 in the figure in contact with the inner surface of the intermediate transfer belt 20, and composes a transfer unit for the image forming apparatus so as to travel from the first unit 10Y to the fourth unit 10K.

The supporting roll 24 is pushed by a spring or the like (not shown) so as to be apart from the driving roll 22, and the intermediate transfer belt 20 wrapped around these rolls is under a certain tension. An intermediate transfer medium cleaning device 30 is provided on the intermediate transfer belt 20 at the image holder side so as to be opposed to the driving roll 22.

The development devices (development units) 4Y, 4M, 4C, and 4K in the units 10Y 10M, 10C, and 10K accommodate four color toners, or yellow, magenta, cyan, and black toners contained in toner cartridges 8Y, 8M, 8C, and 8K.

Since the above-described first to fourth units 10Y, 10M, 10C, and 10K have an equivalent structure, the first unit 10Y for forming an yellow image arranged on the upstream side in the traveling direction of the intermediate transfer belt is described as a typical example. Descriptions of the second to fourth units 10M, 10C, and 10K are omitted by assigning the same reference numerals as the first unit 10Y to the corresponding parts, wherein the numerals are followed by magenta (M), cyan (C), or black (K) in place of yellow (Y).

The first unit 10Y has a photoreceptor 1Y which serves as an image holder. Around the photoreceptor 1Y, a charging roll 2Y for charging the surface of the photoreceptor 1Y to a certain potential, an exposure device 3 for exposing the charged surface to a laser beam 3Y based on the color-decomposed image signals to form an electrostatic latent image, a development device (developing unit) 4Y for supplying a charged toner to the electrostatic latent image to develop an electrostatic latent image, a primary transfer roll 5Y (primary transfer unit) for transferring the developed toner image onto the intermediate transfer belt 20, and a photoreceptor cleaning device (cleaning unit) 6Y for removing the toner remaining on the surface of the photoreceptor 1Y after primary transfer using a cleaning blade, are arranged in this order.

The primary transfer roll 5Y is arranged within the intermediate transfer belt 20 in a position opposed to the photoreceptor 1Y. Further, bias power supplies (not shown) for applying primary transfer bias are connected to each of the primary transfer rolls 5Y, 5M, 5C, and 5K. The bias power supplies are controlled by a control unit (not shown) to vary the transfer bias to be applied to the primary transfer rolls.

The action of forming an yellow image in the first unit 10Y is described below. Firstly, previous to the action, the surface of the photoreceptor 1Y is charged to a potential of about −600 V or more and −800 V or less by the charging roll 2Y.

The photoreceptor 1Y is formed on a conductive substrate (volume resistivity at 20° C.: $1\times10^6$ Ωcm or less) as a laminate of photosensitive layers. The photosensitive layer normally has high resistance (resistance equivalent to that of common resins), and has the property of changing the specific resistance of the area irradiated with the laser beam 3Y. On this account, the laser beam 3Y is emitted to the surface of the charged photoreceptor 1Y via the exposure device 3 according to the image data for yellow transmitted from the control unit (not shown). The laser beam 3Y is radiated to the photosensitive layer on the surface of the photoreceptor 1Y, thereby an electrostatically charged image of yellow printing pattern is formed on the surface of the photoreceptor 1Y.

An electrostatically charged image is an image formed by charging on the surface of the photoreceptor 1Y, and is a so-called negative latent image formed as follows: irradiation with the laser beam 3Y decreases the specific resistance of the photosensitive layer in the irradiated area, thereby the electrified charges on the surface of the photoreceptor 1Y pass through, while electric charges remain in the area which has not irradiated with the laser beam 3Y to form an image.

The electrostatically charged image formed on the photoreceptor 1Y as described above is rotated to the predetermined development position along with the traveling of the photoreceptor 1Y. Then, at the development position, the electrostatically charged image on the photoreceptor 1Y is developed into a visible image (developed image) by the development device 4Y.

The development device 4Y accommodates, for example, an yellow toner. The yellow toner is friction-charged by being stirred in the development device 4Y to have an electric charge having the same polarity (negative polarity) with the electrified charge on the photoreceptor 1Y, and is held on the developer roll (developer holder). Then the surface of the photoreceptor 1Y passes through the development device 4Y, thereby the yellow toner electrostatically adheres to the discharged latent image area on the surface of the photoreceptor 1Y, and the latent image is developed by the yellow toner. The photoreceptor 1Y having the yellow toner image keeps traveling at a predetermined rate, and the toner image developed on the photoreceptor 1Y is carried to a predetermined primary transfer position.

When the yellow toner image on the photoreceptor 1Y is carried to the primary transfer, a predetermined primary transfer bias is applied to a primary transfer roll 5Y, and an electrostatic force from the photoreceptor 1Y toward the primary transfer roll 5Y is exerted on the toner image, thereby the toner image on the photoreceptor 1Y is transferred onto the intermediate transfer belt 20. The applied transfer bias has a positive polarity opposite to the negative polarity of the toner, and for example, in the first unit 10Y, the bias is controlled by the control unit (not shown) to about +10 μA.

The toner remaining on the photoreceptor 1Y is removed and collected by the cleaning device 6Y.

Further, the primary transfer bias applied to primary transfer rolls 5M, 5C, and 5K in the second unit 10M and afterward is also controlled in the same manner as in the first unit.

In this manner, the yellow toner image is transferred to the intermediate transfer belt 20 in the first unit 10Y, and the intermediate transfer belt 20 is sequentially carried through the second to fourth units 10M, 10C, and 10K, wherein the toner images of each color are transferred to the belt in layers.

Through the first to fourth units, four color toner images are transferred in layers to the intermediate transfer belt 20, and the intermediate transfer belt 20 comes to a secondary transfer part composed of the intermediate transfer belt 20, the supporting roll 24 in contact with the inner surface of the intermediate transfer belt 20, and a secondary transfer roll (secondary transfer unit) 26 arranged on the intermediate transfer belt 20 at the image supporting side. A recording medium P is fed at a predetermined time via a feeding mechanism to the gap where the secondary transfer roll 26 and the intermediate transfer belt 20 are pressed against each other under pressure, and a predetermined secondary transfer bias is applied to the supporting roll 24. At that time, the applied transfer bias has the same polarity (−) with the polarity of the toner (−), thereby an electrostatic force from the intermediate transfer belt 20 toward the recording medium P is exerted on the toner image, and the toner image on the intermediate transfer belt 20 is transferred onto the recording medium P. The secondary transfer bias is determined according to the resistance detected by a resistance detection means (not shown) for detecting the resistance in the secondary transfer part, and is subjected to voltage control.

Subsequently the recording medium P is sent to a fixing device (fixing unit) 28, the toner image is heated, and the multicolored toner image is melted and fixed on the recording medium P. The recording medium P on which the fixing of the color image has been completed is carried toward an ejection part, thus the process of color image formation is finished.

In the above-described image forming apparatus, a toner image is transferred to the recording medium P via the intermediate transfer belt 20. Alternatively, the toner image may be transferred to the recording medium P directly from the photoreceptor.

In the image forming apparatus shown in FIG. 9, the image forming units Y, M, C, and BK include photoreceptor drums 201Y, 201M, 201C, and 201BK, respectively, the photoreceptor drums being rotatable in a clockwise direction shown by the arrow at a certain peripheral speed (process speed). The photoreceptor drums 201Y, 201M, 201C, and 201BK are surrounded by charging rolls 202Y, 202M, 202C, and 202BK, exposure devices 203Y, 203M, 203C, and 203BK, development devices for each color (yellow development device 204Y, magenta development device 204M, cyan development device 204C, and black development device 204BK), and photoreceptor drum cleaning members 205Y, 205M, 205C, and 205BK, respectively.

The four image forming units Y, M, C, and BK are arranged in parallel to a recording medium conveyor/transfer belt 206, the image forming units BK, C, M, and Y in this order. The image forming units Y, M, C, and BK may be appropriately changed according to the image formation method.

The recording medium conveyor/transfer belt 206 is stretched by belt supporting rolls 210, 211, 212, and 213 from the inner surface side, thereby forming a transfer unit for an image forming apparatus. The recording medium conveyor/transfer belt 206 is rotatable in a counterclockwise direction shown by the arrow at the same peripheral speed with the photoreceptor drums 201Y, 201M, 201C, and 201BK, and is arranged so as to be partially in contact with the photoreceptor drums 201Y, 201M, 201C, and 201BK between the belt supporting rolls 212 and 213. The recording medium conveyor/transfer belt 206 is provided with a belt cleaning member 214.

Transfer rolls 207Y, 207M, 207C, and 207BK are arranged in contact with the inner surface of the recording medium conveyor/transfer belt 206 so as to oppose the photoreceptor drums 201Y, 201M, 201C, and 201BK, respectively. The transfer rolls 207Y, 207M, 207C, and 207BK and the photoreceptor drums 201Y, 201M, 201C, and 201BK form a transfer region for transferring a toner image to a recording medium 216 via the recording medium conveyor/transfer belt 206. The transfer rolls 207Y, 207M, 207C, and 207BK may be located immediately below the photoreceptor drums 201Y, 201M, 201C, and 201BK, or deviated from the points immediately below the drums.

A fixing device 209 is arranged such that a recording medium 216 is carried thereto after traveling through the transfer regions between the recording medium conveyor/transfer belt 206 and the photoreceptor drums 201Y 201M, 201C, and 201BK.

The recording medium 216 is carried by a recording medium conveyor roll 208 to the recording medium conveyor/transfer belt 206.

In the image forming unit BK, the photoreceptor drum 201BK is rotated. The charging roll 202BK is driven in synchronization with the photoreceptor drum 201BK, whereby the surface of the photoreceptor drum 201BK is charged to have a certain polarity and electric potential. The photoreceptor drum 201BK having a charged surface is then exposed imagewise by the exposure device 203BK, whereby an electrostatic latent image is formed on the surface.

Subsequently, the electrostatic latent image is developed by the black development device 204BK, whereby a toner image is formed on the surface of the photoreceptor drum 201BK. The developer used herein may be of one-component or two-component type.

When the toner image travels through the transfer region between the photoreceptor drum 201BK and the recording medium conveyor/transfer belt 206, the recording medium 216 is electrostatically adsorbed to the recording medium conveyor/transfer belt 206 and carried to the transfer region, and then transferred to the surface of the recording medium 216 in turn by the electric field formed by the transfer bias applied by the transfer roll 207BK.

Thereafter, the toner remaining on the photoreceptor drum 201BK is removed by the photoreceptor drum cleaning member 205BK. Then, the photoreceptor drum 201BK sets about the next image transfer.

The above-described image transfer is carried out also in the image forming units C, M, and Y in the same manner.

The recording medium 216 having a toner image transferred by the transfer rolls 207BK, 207C, 207M, and 207Y is carried to the fixing device 209, where the toner image is fixed.

Through the above process, an image is formed on the recording medium.

EXAMPLES

The present invention is further described below with reference to examples, but the invention will not limited to these examples.

Example 1

Firstly, carbon black (trade name: SPECIAL BLACK 4, manufactured by Evonik Degussa Japan) is added at a solid weight ration of 8% by weight to a solution of polyamic acid in N-methyl-2-pyrrolidone (NMP) (trade name: U IMIDE KX, manufactured by Unitika, Ltd., solid concentration: 20% by weight) containing biphenyl tetracarboxylic dianhydride (BPDA) and p-phenylenediamine (PDA), and the mixture is dispersed (200 N/mm$^2$, five times) using a jet mill disperser (trade name: GEANUS PY, manufactured by Geanus Co.). The carbon black-dispersed polyamic acid solution obtained is passed through a 20 μm stainless steel mesh to remove foreign matter and carbon black aggregates. Further, the solution is subjected to vacuum deaeration for 15 minutes under stirring, thus preparing a final coating liquid.

Subsequently, the coating liquid obtained is applied to an SUS plate (200 mm square) using a wire bar in a thickness of 0.6 mm to form a coating film. Thereafter, the coating film is dried under heating at 125° C. for 40 minutes, thus obtaining a dried coating film. The proportion of residual solvent in the dried coating film is 18%.

Thereafter, an NMP solution is applied to the entire surface of the dried coating film using a wire bar (coating weight: 0.1 g/cm$^2$). The SUS plate is allowed to stand in this state for 15 minutes, heated at 165° C. for 30 minutes to dry the applied NMP solution, and then calcined at 250° C., thus producing a polyimide resin film.

Comparative Example 1

A polyimide resin film is produced in the same manner as in Example 1, except that calcination is carried out at 250° C. without the application of the NMP solution to the dried coating film.

(Evaluation 1)

The polyimide resin films obtained in Example 1 and Comparative Example 1 are rubbed against a TEFLON (registered trademark) plate, and the charge potential of the resin films immediately after removal is measured using MODEL 542 manufactured by Trek Inc. The charge potential is measured five times, and the maximum value is recorded as the maximum charge voltage.

The maximum charge voltage of the polyimide resin film obtained in Example 1 is 0.48 KV.

The maximum charge voltage of the polyimide resin film obtained in Comparative Example 1 is 9.8 KV.

These results suggest that the polyimide resin film produced in Example 1 has antistatic function, and is useful as an antistatic film.

Example 2

Carbon black (trade name: SPECIAL BLACK 4, manufactured by Evonik Degussa Japan) is added at a solid weight ration of 18% by weight to a solution of polyamic acid in NMP (trade name: U IMIDE KX, manufactured by Unitika, Ltd., solid concentration: 20% by weight) containing biphenyl tetracarboxylic dianhydride (BPDA) and p-phenylenediamine (PDA), and the mixture is dispersed (200 N/mm$^2$, five times) using a jet mill disperser (trade name: GEANUS PY, manufactured by Geanus Co.). The carbon black-dispersed polyamic acid solution obtained is passed through a 20 μm stainless steel mesh to remove foreign matter and carbon black aggregates. Further, the solution is subjected to vacuum deaeration for 15 minutes under stirring, thus preparing a final coating liquid.

Subsequently, the coating liquid obtained is applied to an SUS plate (200 mm square) using a RDS22 wire bar in a thickness of 0.3 mm to form a coating film. Thereafter, the coating film is dried under heating at 125° C. for 60 minutes, thus obtaining a dried coating film. The proportion of residual solvent in the dried coating film is 14%.

Thereafter, a punched metal plate having holes with a diameter of 0.5 mm arranged at a pitch of 1 mm is brought into intimate contact with the dried coating film, and then coated with an NMP solvent (coating weight: 0.1 g/cm$^2$), thereby applying the NMP solvent to the dried coating film in the form of dots. The SUS plate is allowed to stand in this state for 15 minutes, heated at 165° C. for 30 minutes to dry the applied NMP solution, and then calcined at 250° C., thus producing a polyimide resin film.

Comparative Example 2

A polyimide resin film is produced in the same manner as in Example 2, except that calcination is carried out at 250° C. without the application of the NMP solution to the dried coating film.

(Evaluation 2)

The volume resistivity and surface resistivity of the polyimide resin films produced in Example 2 and Comparative Example 2 are measured.

The polyimide resin film produced in Example 2 has a surface resistivity of 11.0 Log Ω at the surface coated with the NMP solution, and a volume resistivity of 7.2 Log Ω, indicating that the film has anisotropic conductivity.

On the other hand, the polyimide resin film produced in Comparative Example 2 has a surface resistivity of 11.4 Log Ω, a volume resistivity of 10.5 Log Ω, indicating that the film has no anisotropic conductivity.

These results suggest that the polyimide resin film produced in Example 2 has anisotropic conductivity, and is useful as an anisotropic conductive film.

The surface resistivity and volume resistivity are measured by the methods described in the second exemplary embodiment on the basis of FIGS. 5A and 5B.

Example 3

Firstly, carbon black (trade name: SPECIAL BLACK 4, manufactured by Evonik Degussa Japan) is added at a solid weight ration of 8% by weight to a solution of polyamic acid in N-methyl-2-pyrrolidone (NMP) (trade name: U IMIDE KX, manufactured by Unitika, Ltd., solid concentration: 20% by weight) containing biphenyl tetracarboxylic dianhydride (BPDA) and p-phenylenediamine (PDA), and the mixture is dispersed (200 N/mm$^2$, five times) using a jet mill disperser (trade name: GEANUS PY, manufactured by Geanus Co.). The carbon black-dispersed polyamic acid solution obtained is passed through a 20 μm stainless steel mesh to remove foreign matter and carbon black aggregates. Further, the solution is subjected to vacuum deaeration for 15 minutes under stirring, thus preparing a final coating liquid.

Subsequently, an uncoated cylindrical die (outside diameter: 302 mm, length: 500 mm, wall thickness: 10 mm) is accurately weighed. The coating liquid obtained as described above is applied to the outer peripheral surface of the cylindrical die in a thickness of 0.5 mm using a dispenser, developed under rotating at 1500 rpm for 15 minutes, thereby forming a coating film. The total weight of the coated cylindrical die is accurately weighed, whereby the weight of the coating film is calculated. In addition, the amount of residual solvent in the coating film is calculated from the solid content and the input of carbon black.

Thereafter, the outside of the coated cylindrical die is exposed to hot air at 60° C. for 30 minutes under rotating at 250 rpm, and heated at 120° C. for 40 minutes to dry the coating film. After completion of drying, the total weight of the cylindrical die having the dried coating film is accurately weighed, whereby the weight of the coating film is calculated. Thereafter, the weight of the dried coating film is subtracted from the weight of the undried coating film to determine the amount of evaporated solvent. Then, the amount of evaporated solvent is subtracted from the amount of residual solvent in the undried coating film to determine the amount of residual solvent, and the amount of residual solvent is divided by the weight of the dried coating film to determine the proportion of residual solvent in the dried coating film. As a result of this, the proportion of residual solvent is determined as 25%.

Subsequently the cylindrical die having the dried coating film is immersed in an NMP solution for 10 seconds, pulled up therefrom, thereby applying the NMP solution to the surface of the dried coating film (coating weight: 0.1 g/cm$^2$). After standing for 15 minutes, the outside of the cylindrical die is exposed to hot air at 60° C. for 30 minutes, and heated at 150° C. for 60 minutes, thereby drying the applied NMP solution. Thereafter, the cylindrical die having the dried coating film is heated to calcination temperature (250° C.) in a standing state thereby convert the imide for one hour, thus obtaining a polyimide endless belt.

Example 4

A polyimide endless belt is obtained in the same manner as in Example 3, except that the outside of the coated cylindrical die is exposed to hot air at 60° C. for 30 minutes under rotating at 250 rpm, and then heated at 120° C. for 60 minutes thereby drying the coating film. The proportion of residual solvent in the dried coating film after drying under the above conditions is 18%.

Comparative Example 3

A polyimide endless belt is obtained in the same manner as in Example 3, except that the outside of the coated cylindrical die is exposed to hot air at 60° C. for 30 minutes under rotating at 250 rpm, and then heated at 120° C. for 20 minutes thereby drying the coating film. The proportion of residual solvent in the dried coating film after drying under the above conditions is 35%.

Comparative Example 4

A polyimide endless belt is obtained in the same manner as in Example 3, except that the NMP solution is not applied to the dried coating film.

A belt section is prepared according to the above-described procedure, the section is directly observed using a transmission electron microscope to determine whether particles are present or absent therein, thereby confirming the presence of particle-free, particle-localized, and particle-containing regions.

Another belt section is prepared according to the above-described procedure, the belt section (sample) is observed in a 10 μm square to measure the flowing current and height (depth) using D3000 and NANOSCOPE III manufactured by Digital Instruments, thereby determining the maximum current flowing through the region extending from the outermost surface to a depth of 15 μm, and the maximum current flowing through the region provided beyond a depth of 15 μm from the outermost surface to the innermost surface.

Figure 10:
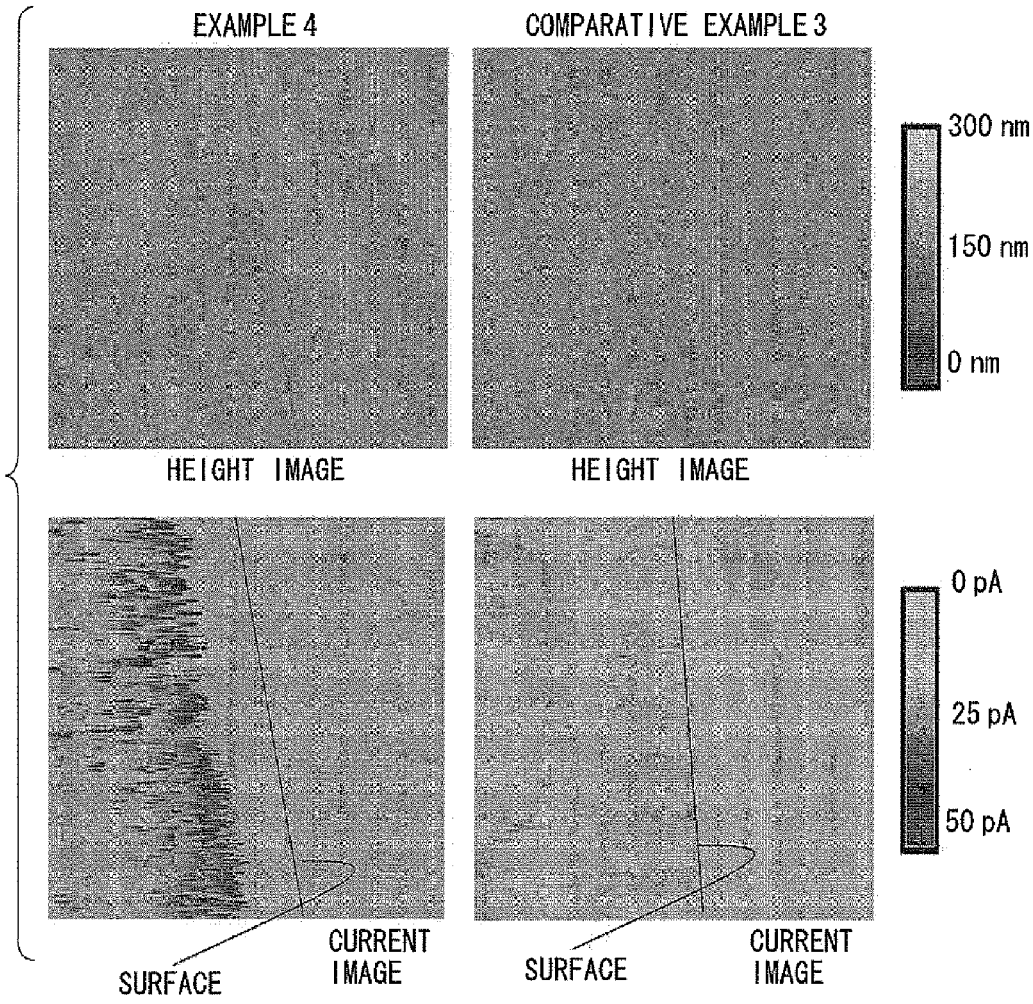
FIG. 10 shows the current image and height image (depth image) of the polyimide endless belts produced in Example 2 and Comparative Example 1, observed using D3000 and NANOSCOPE III manufactured by Digital Instruments.

FIG. 10 shows the current image and height image (depth image) of the polyimide endless belts produced in Example 4 and Comparative Example 3, studied using D3000 and NANOSCOPE III manufactured by Digital Instruments.

—Measurement of Surface Resistivity and Volume Resistivity—

According to the above-described procedure, the volume resistivity of the outermost surface of the belt and the volume resistivity of the belt are measured.

—Evaluation of Electrical Resistance—

The endless belt obtained above is used as an intermediate transfer belt, and mounted in a modified DOCUCENTRE COLOR 2220 manufactured by Fuji Xerox Co., Ltd. (process speed: 500 mm/sec, primary transfer electric current: 45 μA, and secondary transfer voltage: 3.5 kV), and a print test is carried out in an environment at 10° C., RH15%. In the test, printing is carried out on 10,000 sheets of A4 sized C2 paper manufactured by Fuji Xerox Co., Ltd. The surface resistivity of the outermost surface of the belt and the volume resistivity of the belt are measured before and after print test, and the values are compared.

The surface resistivity and the volume resistivity are measured in accordance with the above-described procedure.

TABLE 1

| | Presence or absence of regions/distance from outermost surface | Maximum current flowing through the region extending from belt outermost surface to a depth of 15 μm | Maximum electric current flowing through the region provided beyond a dept of 15 μm in the thickness direction from the outermost surface to the innermost surface | Initial surface resistivity (LogΩ/□) | Surface resistivity after test (LogΩ/□) | Initial volume resistivity (LogΩ/□) | Volume resistivity after test (LogΩ/□) |
|---|---|---|---|---|---|---|---|
| Example 3 | Particle-free region/0.7 μm from outermost surface<br>Particle-localized region/0.7 μm to 5 μm from outermost surface | 120 pA | 20 pA | 10.6 | 10.6 | 9.8 | 9.8 |
| Example 4 | Particle-free region/1.5 μm from outermost surface<br>Particle-localized region/1.5 μm to 12 μm from outermost surface | 630 pA | 63 pA | 10.2 | 10.2 | 9.4 | 9.4 |
| Comparative Example 3 | No particle-free region/No particle-localized region | 20 pA | 7 pA | 11.2 | 10.7 | 10.5 | 10.3 |
| Comparative Example 4 | No particle-free region/No particle-localized region | 38 pA | 45 pA | 10.8 | 10.1 | 10.2 | 9.8 |

(Evaluation 3)

The polyimide endless belts obtained are subjected to the following evaluations. The results are shown in Table 1.

—Presence or Absence of Conductive Particles (Carbon Black), and Evaluation of Conductivity—

The above results indicate that the variation (decrease) of electrical resistance in examples is smaller than that in comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. A tubular body comprising a layer containing a resin and conductive particles, the layer having a first region that is substantially free of the conductive particles and is provided at an outermost surface, a second region that contains the conductive particles in a localized state and is provided closer to an innermost surface than the first region, and a third region that contains the conductive particles at a lower density than the second region and is provided closer to the innermost surface than the second region.

2. The tubular body of claim 1, wherein the first and second regions are provided between the outermost surface and a depth of approximately 15 μm in a thickness direction of the layer.

3. The tubular body of claim 1, wherein the electrical conductivity of the second region is from five to 100 times higher than the electrical conductivity of the third region provided beyond a depth of approximately 15 μm in the thickness direction from the outermost surface.

4. The tubular body of claim 1, further comprising a separate functional layer at an outer and/or inner peripheral surface of the layer.

5. The tubular body of claim 1, wherein a thickness of the first region is from approximately 0.5 μm to approximately 3 μm.

6. The tubular body of claim 1, wherein the resin comprises one resin selected from the group consisting of a polyimide resin, a polyamide resin, a polyamide imide resin, a polyether ether ester resin, a polyalylate resin, and a polyester resin.

7. The tubular body of claim 1, wherein the surface resistivity of an outer peripheral surface is from approximately 9 (Log ΩW/□) to approximately 13 (Log ΩW/□) in terms of common logarithm.

8. The tubular body of claim 1, which has a volume resistivity of from approximately 8 (Log Ωcm) to approximately 13 (Log Ωcm) in terms of common logarithm.

9. A transfer unit comprising the tubular body of claim 1 and a plurality of rolls around which the tubular body is wrapped under tension, the transfer unit being attachable to and detachable from the body of an image forming apparatus.

10. An image forming apparatus comprising:

an image holder;

a charging unit that charges a surface of the image holder;

a latent image forming unit that forms a latent image on the surface of the image holder;

a development unit that develops the latent image on the surface of the image holder into a toner image with a toner;

the tubular body of claim 1 as an intermediate transfer medium to which the toner image formed on the surface of the image holder is transferred;

a primary transfer unit that primarily transfers the toner image formed on the surface of the image holder to a surface of the intermediate transfer medium;

a secondary transfer unit that secondarily transfers the toner image transferred to the surface of the intermediate transfer medium to a recording medium; and a fixing unit that fixes the toner image transferred to the recording medium.

* * * * *